US008104880B2

(12) United States Patent
Sugahara

(10) Patent No.: US 8,104,880 B2
(45) Date of Patent: Jan. 31, 2012

(54) LIQUID CARTRIDGE AND RECORDING SYSTEM

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 350 days.

(21) Appl. No.: 12/413,073

(22) Filed: Mar. 27, 2009

(65) Prior Publication Data

US 2009/0184991 A1 Jul. 23, 2009

Related U.S. Application Data

(63) Continuation-in-part of application No. PCT/JP2007/069070, filed on Sep. 28, 2007.

(30) Foreign Application Priority Data

Sep. 29, 2006 (JP) ..... 2006-269973
Sep. 29, 2006 (JP) ..... 2006-269974
Nov. 30, 2006 (JP) ..... 2006-324492

(51) Int. Cl.
*B41J 2/175* (2006.01)

(52) U.S. Cl. ..... 347/85; 347/84; 347/7

(58) Field of Classification Search ..... 347/5, 7, 347/9, 84, 95, 96
See application file for complete search history.

(56) References Cited

U.S. PATENT DOCUMENTS 6,378,971 B1 4/2002 Tamura et al.
6,893,118 B2 * 5/2005 Murakami et al. ..... 347/84
7,357,494 B2 4/2008 Katayama et al.
7,419,233 B2 9/2008 Katayama
2001/0007615 A1 7/2001 Kawakami
(Continued)

FOREIGN PATENT DOCUMENTS

EP 0955169 A2 11/1999
(Continued)

OTHER PUBLICATIONS

International Bureau; Notification of Transmittal of Translation of the International Preliminary Report on Patentability in International Application No. PCT/JP2007/069070 (parent to the above-captioned U.S. patent application), mailed Apr. 30, 2009.

(Continued)

*Primary Examiner* — Lam S Nguyen
(74) *Attorney, Agent, or Firm* — Baker Botts L.L.P.

(57) ABSTRACT

A liquid cartridge mountable in a recording device includes a liquid accommodating chamber that accommodates liquid therein, a float movably disposed in the liquid accommodating chamber, and a detection section to be detected by an external light detector for determining remaining amounts of the liquid in the liquid accommodating chamber. The detection section is movably disposed in the liquid accommodating chamber to move along a predetermined path in conjunction with movements of the float. The light detector includes a light emitting section that emits light and a light receiving section that receives the light. The detection section includes a first section and a second section; the first section transmits the light when the first section is in a detection point, while the second section blocks the light, the first section and the second section being arranged alternately. An amount of liquid accommodated in the liquid accommodating chamber when the liquid cartridge is mounted in the recording device is determined based on a number of times the light emitted from the light emitting section traverses the alternately arranged first and second sections during mounting the liquid cartridge in a mounting direction in the recording device.

25 Claims, 22 Drawing Sheets

U.S. PATENT DOCUMENTS

| | | | | |
|---|---|---|---|---|
| 2002/0005869 | A1 | 1/2002 | Locher et al. | |
| 2005/0195254 | A1 * | 9/2005 | Takagi et al. | 347/85 |

FOREIGN PATENT DOCUMENTS

| | | | |
|---|---|---|---|
| EP | 1520706 | A2 | 4/2005 |
| EP | 1570994 | A1 | 9/2005 |
| JP | S63-115757 | A | 5/1988 |
| JP | S63-147650 | A | 6/1988 |
| JP | H08-025646 | A | 1/1996 |
| JP | 2001-287380 | A | 10/2001 |
| JP | 2004-034406 | A | 2/2004 |
| JP | 2005-104023 | A | 4/2005 |
| JP | 2005-125738 | A | 5/2005 |
| JP | 2005-262565 | A | 9/2005 |
| JP | 2006-231557 | A | 9/2006 |

OTHER PUBLICATIONS

European Patent Office; European Search Report in Application No. 07828811.5 (counterpart to the above-captioned U.S. patent application) mailed Oct. 22, 2009.

* cited by examiner

LIQUID CARTRIDGE AND RECORDING SYSTEM

CROSS REFERENCE TO RELATED APPLICATION

This application claims priorities from Japanese Patent Application Nos. 2006-269973 filed Sep. 29, 2006, 2006-269974 filed Sep. 29, 2006, and 2006-324492 filed Nov. 30, 2006. This application is also a continuation-in-part of International Application No. PCT/JP2007/069070 filed Sep. 28, 2007 in Japan Patent Office as a Receiving Office. The contents of these applications are incorporated herein by reference.

TECHNICAL FIELD

The present invention relates to a liquid cartridge, more particularly to a liquid cartridge mountable in a recording device for supplying liquid thereto, and also relates to a recording system including the liquid cartridge.

BACKGROUND

In a conventional recoding device that ejects recording liquid such as an inkjet recording device, a separate liquid cartridge is often used for supplying liquid to the recoding device. If there is a small amount of liquid left in the liquid cartridge when a user replaces the liquid cartridge, the liquid in the liquid cartridge will soon become empty if a large amount of printing is performed right after the replacement. In such a case, the user needs to replace the liquid cartridge again in the middle of the printing operation. In order to avid such a situation, there is a need for a configuration that detects whether the amount of liquid remaining in the liquid cartridge is small, and, if so, warns that the cartridge needs to be replaced soon.

For example, Japanese Patent Application Publication No. 2004-34406 (FIG. 2) discloses that a float is provided in a liquid cartridge so as to be dislocated in accordance with a decrease in the amount of liquid in the liquid cartridge. A degree of displacement of the float in a horizontal direction can be detected by a reflective optical sensor that moves horizontally relative to the liquid cartridge. This construction can detect how much liquid is left in the liquid cartridge as needed. Or alternatively, a plurality of optical sensors can be employed with respect to the horizontal direction, instead of moving an optical sensor, in order to detect residual amounts of liquid as in this patent reference. With these methods, detecting amounts of liquid left in a liquid cartridge right after the liquid cartridge is mounted may determine whether the remaining amount of liquid in the liquid cartridge is little.

However, if an optical sensor is configured to move relative to a liquid cartridge as disclosed in patent document 1, dimensions of a recoding device tend to be large. Moreover, providing a plurality of optical sensors leads to an increase in the number of parts. Hence, a liquid cartridge employing the above-described detecting methods necessitates an increase in costs of a recoding device.

SUMMARY

It is an object of the present invention to provide a liquid cartridge and recoding system capable of detecting residual amounts of liquid when the liquid cartridge is being mounted without increasing costs of the recording system.

A liquid cartridge according to an embodiment of the present invention is mountable in a recording device. The liquid cartridge includes a liquid accommodating chamber that accommodates liquid therein, a float movably disposed in the liquid accommodating chamber, and a detection section to be detected by an external light detector for determining remaining amounts of the liquid in the liquid accommodating chamber. The detection section is movably disposed in the liquid accommodating chamber to move along a predetermined path in conjunction with movements of the float, the light detector including a light emitting section that emits light and a light receiving section that receives the light, the detection section including a first section and a second section, the first section transmitting the light when the first section is in a detection point, the second section blocking the light, the first section and the second section being arranged alternately. An amount of liquid accommodated in the liquid accommodating chamber when the liquid cartridge is mounted in the recording device is determined based on a number of times the light emitted from the light emitting section traverses the alternately arranged first and second sections during mounting the liquid cartridge in a mounting direction in the recording device.

Further, a recoding system according to an embodiment of the present invention includes a liquid cartridge and a recording device in which the liquid cartridge is mounted. The recording device includes a mount section in which the liquid cartridge is mounted and a light detector including a light emitting section that emits light and a light receiving section that receives the light from the light emitting section, a portion of the ink cartridge mounted in the mount section being interposed between the light emitting section and the light receiving section. The liquid cartridge includes a liquid accommodating chamber that accommodates liquid therein, a float movably disposed in the liquid accommodating chamber, and a detection section to be detected by the light detector for determining remaining amounts of the liquid in the liquid accommodating chamber. The detection section is movably disposed in the liquid accommodating chamber to move along a predetermined path in conjunction with movements of the float, the detection section including a first section and a second section, the first section transmitting the light, the second section blocking the light, the first section and the second section being arranged alternately. An amount of liquid accommodated in the liquid accommodating chamber when the liquid cartridge is mounted in the recording device is determined based on a number of times the light emitted from the light emitting section traverses the alternately arranged first and second sections during an operation to mount the liquid cartridge in the recording device.

According to the liquid cartridge and the recording system according to an embodiment of the present invention, the detection section moves along a predetermined path in conjunction with movements of the float in accordance with decrease in the liquid. And the detection section is configured such that an amount of liquid accommodated in the liquid accommodating chamber when the liquid cartridge is mounted in the recording device is determined based on a number of times the light emitted from the light emitting section traverses the alternately arranged first and second sections during an operation to mount the liquid cartridge in the recording device. Accordingly, at which position on the predetermined path the detection section is located can be detected by detecting the light received by the light receiving section and counting the number of times either the first section or the second section traverses the light. That is, amounts of liquid left in the ink cartridge are acquired.

According to another aspect of the present invention, the liquid cartridge is preferably provided with an arm section that connects the float and the detection section and that is pivotably movably supported about a pivot point in the liquid accommodating chamber. With this configuration, since the arm section connects the detection section and the pivot point, the detection section can be made compact, compared with a case in which the detection section is formed in a disk shape. Also, the distance between the detection section and the pivot point can be made longer by simply making the length of the arm longer, thereby enabling the detection section to still be made compact.

According to further aspect of the present invention, preferably the liquid cartridge further includes a restricting portion that restricts movements of the detection section to move only along the predetermined path and also restricts the float to remain immersed in the liquid at a predetermined position when the liquid surface is above the predetermined position. With this construction, the arm is configured not to pivotally move when a sufficient amount of liquid is left, but to start making a pivotal movement when the liquid has decreased to a certain amount. Hence, accurate detection of the residual amounts of liquid becomes possible in a case where remaining amounts of liquid is necessary to be detected, i.e., when the liquid has decreased.

According to still another aspect of the present invention, preferably the detection section moves in a first direction along the predetermined path as the liquid accommodated in the liquid accommodating chamber decreases, the first direction being opposite to the mounting direction. With this construction, at least one of the number of times the first section traverses the light and the number of times the second section traverses the light can reliably change in response to the residual amounts of liquid, when the detection section moves in the first direction opposite to the mounting direction. Hence, residual amounts of liquid can be reliably detected. The detection section can also be configured such that changes in the remaining amount of liquid after the liquid cartridge has been mounted can be detected by positional changes of the detection section. In this case, a single detection section allows detecting both residual amounts of the liquid when mounted and the changes in the amounts of liquid thereafter.

According to further aspect of the present invention, preferably the detection section is positioned above the pivot point. With this construction, the detection section can move in the first direction at a large scale along the predetermined path, thereby allowing the residual mounts of liquid to be detected more reliably.

According to further aspect of the present invention, the detection section preferably includes at least one first section and at least two second sections, and the first and second sections are preferably arranged in the mounting direction. With this construction, the first section and the second section can be in coincidence with a path of light emitted from the light emitting section, regardless of the amounts of liquid left in the liquid accommodating chamber. The first section and the second section moves in the first direction opposite to the mounting direction in accordance with decrease in liquid accommodated in the liquid accommodating chamber, as above described. Accordingly, at least either the number of times the first section traverses or the number of times the second section traverses can change reliably in accordance with decrease of the liquid, when the liquid cartridge is being mounted.

According to further aspect of the present invention, it is preferable that the float and the detection section are integrally formed, and the detection section is of a substantially disk-shaped and has a center, the detection section being pivotally movable about the center, a plurality of first sections and a plurality of second sections being coaxially arranged to be alternate in a radial direction, the plurality of first sections being shorter as closer to the center, a longest first section being arranged in an outermost position. With this construction, when the liquid cartridge is mounted, the detection point of the emitted light can be made movable relative to the detection section in the radial direction thereof. In this case, the light reliably intersects the first sections and the second sections. The first sections extend along the circumference and lengths of the first sections along the circumference are arranged to be shorter, as the first sections are closer to the center. On the other hand, the detection section pivotally moves about the center in response to the decrease of liquid. Hence, at least either the number of times the first sections traverse the light or the number of times the second sections traverse the light can change reliably in accordance with decrease of the liquid. Note that, at least either the number of times the first sections traverse the light or the number of times the second sections traverse the light can also change reliably in accordance with decrease of the liquid in a case where the plurality of first sections is designed to be longer as closer to the center, a longest first section being arranged in an innermost position. Moreover, the detection section is formed in a disk shape. If the detection section has a shape other than a disk, such as a rectangular shape for example, the detection section necessarily has a planar end surface. If the end surface moves past the liquid surface when the detection section pivotally moves, air bubbles may adhere to the end surface. Adherence of air bubbles to the end surface prevents the detection section from moving smoothly, thereby leading to unstable detection of the residual amounts of the liquid. In contrast, if the detection section has a disk shape, no planar end surface is formed as in the rectangular shaped detection section. Hence, air bubbles do not easily adhere when the detection section pivotally moves, thereby leading to stable detection of the residual amounts of liquid.

According to another aspect of the present invention, each of the plurality of first sections has a first end and a second end, and the first ends are preferably aligned in the radial direction. With this structure, each of the first ends is located at a prescribed position the same as each other with respect to the circumferential direction, and the first sections extend in a direction the same with each other along the circumference. Moreover, as described above, the first sections are formed so as to be longer or shorter as closer to the center. Accordingly, in this liquid cartridge, as the liquid decreases, the number of times the first sections traverse the light can be made fewer or greater.

According to further aspect of the present invention, preferably the detection section is further formed with a third section that transmits the light, and the third section extends in the radial direction to the detection point, and the second end of the longest first section is located at a position away from the third section. With this structure, the third section is formed at a position rearward of the first section with respect to a direction in which the detection section moves in response to the decrease in the liquid, i.e., at a position at which the light is irradiated when the liquid has decreased to a minimum amount. On the other hand, the third section extends from the circumference to the detection point. Hence, this liquid cartridge can be configured such that the light never traverses the second section if the liquid has decreased to the minimum amount when the liquid cartridge is mounted, thereby realizing easy detection of a state where the smallest amount of liquid is left in the liquid cartridge. Note that, the second ends of the longest first section may extend to the third section so that the state where the smallest amount of liquid is left in the liquid accommodating chamber can be detected.

According to further aspect of the present invention, the float and the detection section may be integrally formed, and the detection section may be substantially a disk-shaped hand have a center and a circumference along which a plurality of first sections and a plurality of second sections are arranged alternately, the detection section being pivotally movable about the center, and each of the first sections has an elongated shape extending in a direction offset from a radial direction by an angle, the angles being larger or smaller as the plurality of first sections is circumferentially farther from the detection point. With this structure, when the liquid cartridge is mounted, the detection point is configured to be movable relative to the detection section in the radial direction. On the other hand, each first section is configured to have a larger or smaller angle relative to the radial direction as circumferentially farther from the detection point. Therefore, the first sections can be arranged in the radial direction in the detection section. Hence, how many times the light traverses the first sections at the time of mounting the liquid cartridge can change reliably as the liquid decreases.

According to further aspect of the present invention, each of the plurality of first sections has a first end and a second end, each of the first ends of the first sections preferably being formed at a position away from the center by an equi-distance, and the number of times the first sections traverses the light increases or decreases in accordance with decrease in the liquid accommodated in the liquid accommodating chamber during mounting the liquid cartridge in the recording device. With this structure, the liquid cartridge reliably allows detecting smaller amounts of liquid is left as the number of times the light traverses the first sections is fewer or greater.

According to further aspect of the present invention, preferably the plurality of first sections intersects with an inner circle, the inner circle having a center the same as the center of the disk-shaped detection section, the inner circle passing the detection point when the liquid cartridge is mounted in the recording device. With this configuration, when the liquid cartridge is mounted in the recording device, the detection point is configured to move along the circumference relative to the detection section in accordance with the decrease of the liquid. In other words, the light traverses the plurality of the first sections as the liquid decreases. Hence, current residual amount of liquid can be obtained by counting how many first sections have traversed the light by present.

According to further aspect of the present invention, the liquid cartridge may further include a restricting portion that restricts movements of the float and the detection section to be movable linearly in a second direction along the predetermined path, the second direction being perpendicular to a path of light emitted from the light emitting section and also being perpendicular to the mounting direction, and the first section may extend in the second direction, and the first section and the second section may be arranged in the mounting direction. With this arrangement, residual amounts of liquid can also be detected at the time of mounting the ink cartridge even if the detection section moves linearly as the liquid decreases.

According to further aspect of the present embodiment, a plurality of first sections is formed in the detection section, each of the first sections having a length different from each other. With this structure, since each of the first sections has a different length, the number of the first sections the light traverses can reliably change when the liquid cartridge is mounted in the mounting direction. Hence, residual amounts of liquid can also be detected at the time of mounting the liquid cartridge even if the detection section moves linearly as the liquid decreases.

BRIEF DESCRIPTION OF THE DRAWINGS

[FIG. 16(*b*)] A cross-sectional view showing the configuration of the ink cartridge and its surroundings when the amount of ink becomes even less than the state of FIG. 16(*a*);

[FIG. 16(*c*)] A cross-sectional view showing the configuration of the ink cartridge and its surroundings when the amount of ink becomes even smaller than the state of FIG. 16(*b*);

[FIG. 16(*d*)] A cross-sectional view showing an configuration of an ink cartridge according to a variation of the third embodiment and its surroundings when the amount of ink becomes smaller than the state of FIG. 15;

[FIG. 18(*b*)] An elevation view of a remaining-amount detecting member in an ink cartridge according to a variation of the fifth embodiment;

DETAILED DESCRIPTION

Following is an explanation about a printer system 1 according to preferred embodiments of the present invention. In the following description, unless otherwise stated, "upper" and "lower" are used to define that each represents upper and lower respectively in a vertical direction in a state where an ink cartridge of the present invention is mounted on a printer.

First Embodiment

Figure 1:
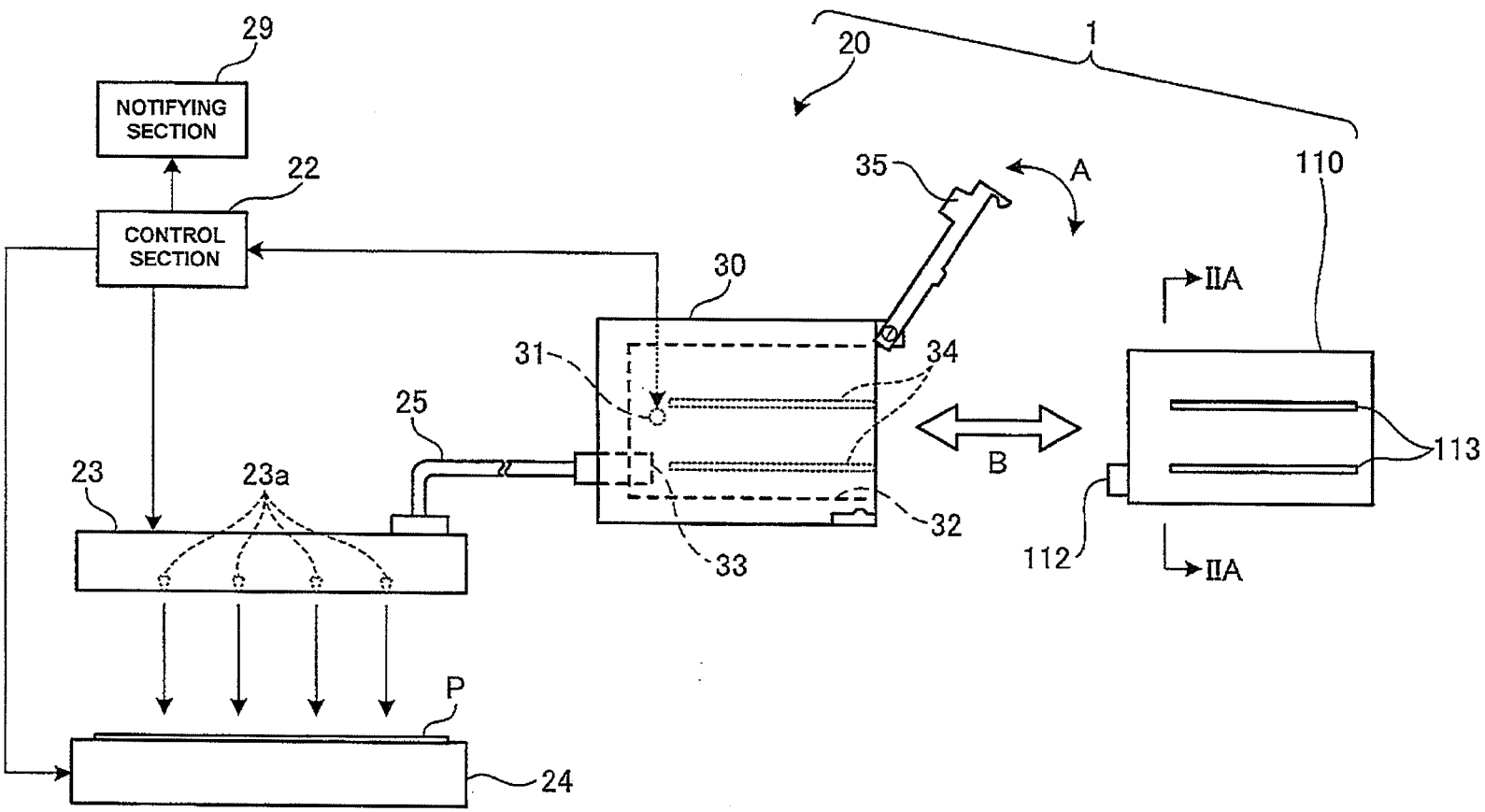
[FIG. 1] A schematic view showing a configuration of a printer system according to a first embodiment of the present invention.

FIG. 1 is a view showing a schematic configuration of a printer system 1. The printer system 1 includes an ink cartridge 110 and an inkjet printer 20. The 20 (hereinafter referred to as "printer 20") includes a control section 22, a notifying section 29, an inkjet head 23, a conveying unit 24, and an accommodating case 30. The control section 22 controls operations of the printer 20. The notifying section 29 notifies a user of the printer 20 of various information on operation status of the printer 20, in accordance with instructions of the control section 22. For example, the notifying section 29 may include a display so that various information can be displayed on the display to notify the user of the information.

The inkjet head 23 has a plurality of nozzles 23*a*. An ink channel (not shown) is formed inside the inkjet head 23. Ink supplied from the ink channel is ejected downward from the nozzles 23*a*. The conveying unit 24 conveys printing paper P to a position below the inkjet head 23. The ink ejected from the inkjet head 23 falls onto the printing paper P conveyed by the conveying unit 24. The control section 22 controls ink ejection from the inkjet head 23 and conveyance of the printing paper P by the conveying unit 24, based on image data transmitted from a personal computer or the like connected to the printer 20. Thus, the printer 20 forms an image corresponding to the image data on the printing paper P.

The accommodating case 30 is a case that accommodates the ink cartridge 110. An accommodating space 32 (mount section) having substantially a rectangular parallelepiped shape is formed within the accommodating case 30. The ink cartridge 110 is mounted in and dismounted from the accommodating space 32 along a direction shown by an arrow B. Concave sections 34 are formed on an inner surface of the accommodating case 30 that defines the accommodating space 32. The concave sections 34 extend from an opening of the accommodating space 32 to the far side of the accommodating space 32 along the direction B.

Further, the accommodating case 30 includes an optical sensor section 31, an ink inlet port 33, and a lid section 35. The optical sensor section 31 is provided such that the optical sensor section 31 is exposed to the accommodating space 32 within the accommodating case 30. The ink inlet port 33 is an opening connecting to an ink outlet port 112 of the ink cartridge 110 so that ink flowing out of the ink outlet port 112 can flow into the ink inlet port 33, when the ink cartridge 110 is mounted in the accommodating case 30. The ink inlet port 33 is in communication with the ink channel within the inkjet head 23 via an ink tube 25. Thus, the ink from the ink cartridge 110 is introduced to the ink channel inside the inkjet head 23. The lid section 35 opens and closes the opening serving as an entrance/exit of the accommodating case 30, and is provided to the accommodating case 30 so as to be capable of swinging in a direction of an arrow A. The lid section 35 opens the opening of the accommodating case 30 when the ink cartridge 110 is mounted in or dismounted from the accommodating case 30, and closes the opening of the accommodating case 30 once the ink cartridge 110 is mounted.

The ink cartridge 110 has substantially a rectangular parallelepiped shape that is approximately the same as the accommodating space 32, and is slightly smaller than the accommodating space 32. Convex sections 113 are formed on a side surface of the ink cartridge 110. The convex sections 113 have shapes that are substantially the same as the concave sections 34 formed in the accommodating case 30, and have sizes that can fit in the concave sections 34. Further, the ink cartridge 110 has an ink outlet port 112. When the ink cartridge 110 is being mounted in or dismounted from the accommodating case 30, the ink cartridge 110 is slid along the direction of the arrow B while the convex sections 113 of the ink cartridge 110 and the concave sections 34 of the accommodating case 30 are coupled to each other. That is, the convex sections 113 and the concave sections 34 are guide members that cause the ink cartridge 110 to move along the detachable direction B. When the ink cartridge 110 is mounted in the accommodating case 30, the ink outlet port 112 is in communication with the ink inlet port 33.

Figure 2A:
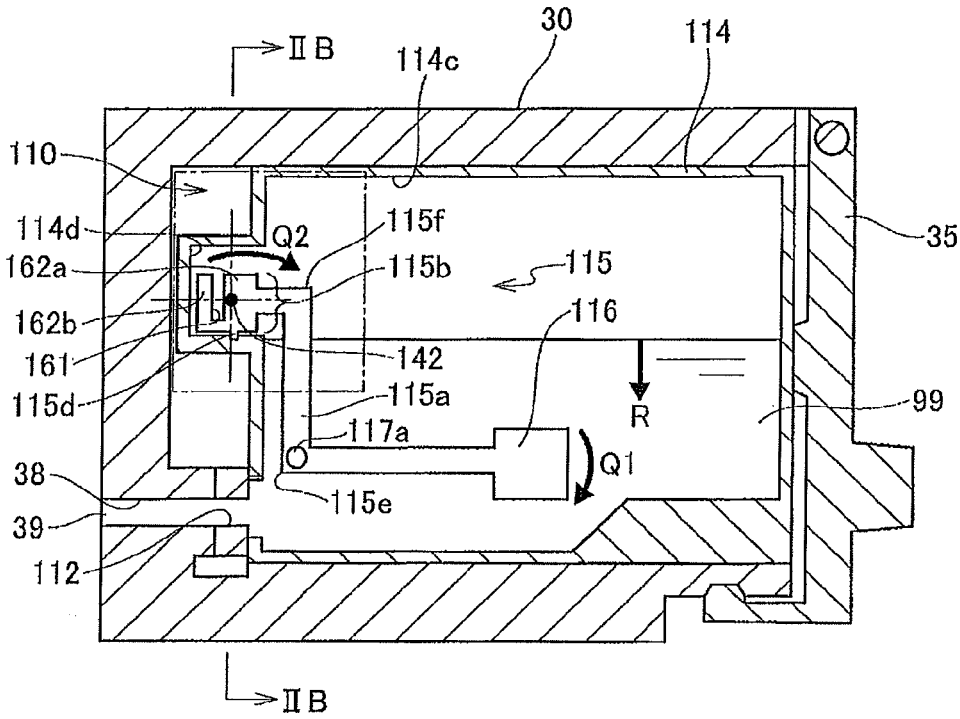
[FIG. 2] Cross-sectional views showing a detailed configuration around an ink cartridge mounted in a printer shown in FIG. 1, wherein (a) is a cross-sectional view taken along a line IIA-IIA in FIG. 1, and (b) is a cross-sectional view taken along a line IIB-IIB in (a)
Figure 2B:
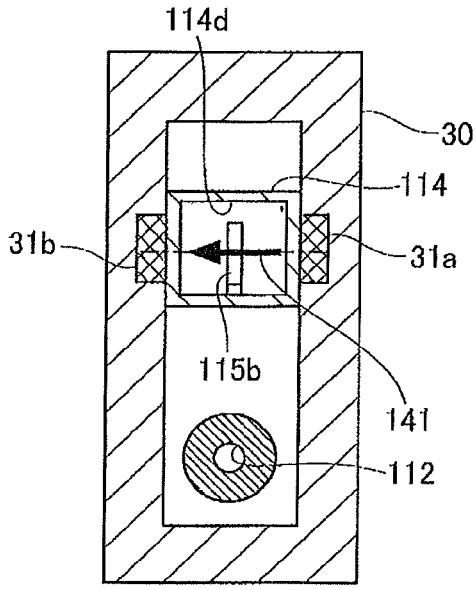
Figure 3A:
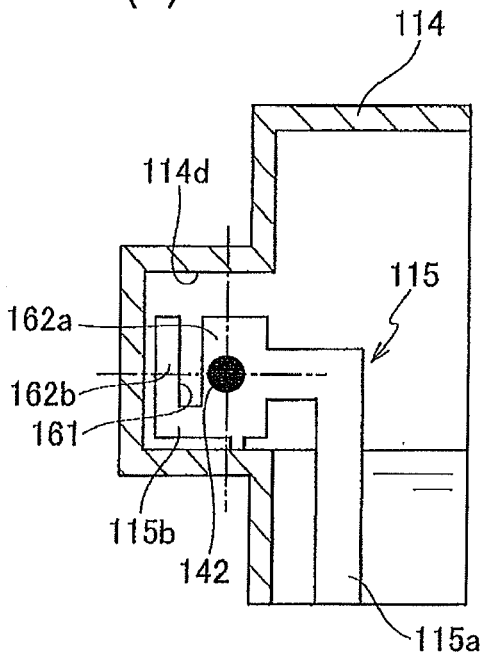
[FIG. 3] Partial enlarged views showing positions of a remaining-amount detecting member in response to amounts of ink remaining in an ink cartridge according to the first embodiment, wherein (a) shows a position of the remaining-amount detecting member when the remaining amount of ink is nearly at a maximum amount, (b) shows a position of the remaining-amount detecting member when the remaining amount of ink becomes less than the maximum amount, (c) shows a position of the remaining-amount detecting member when the remaining amount of ink becomes even smaller, and (d) shows a position of the remaining-amount detecting member when the ink cartridge becomes almost empty.
Figure 3B:
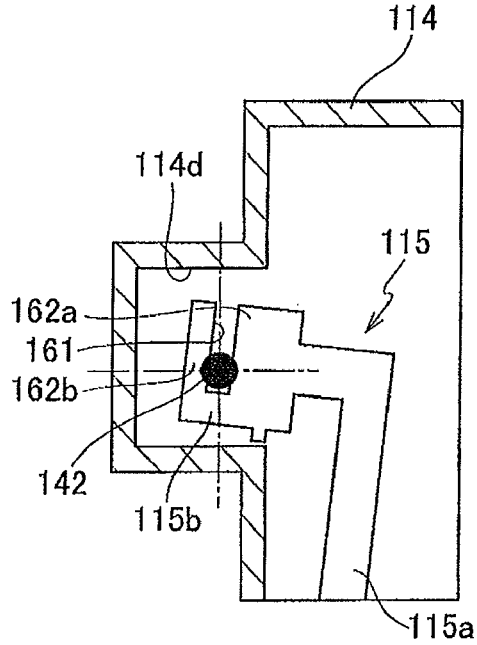
Figure 3C:
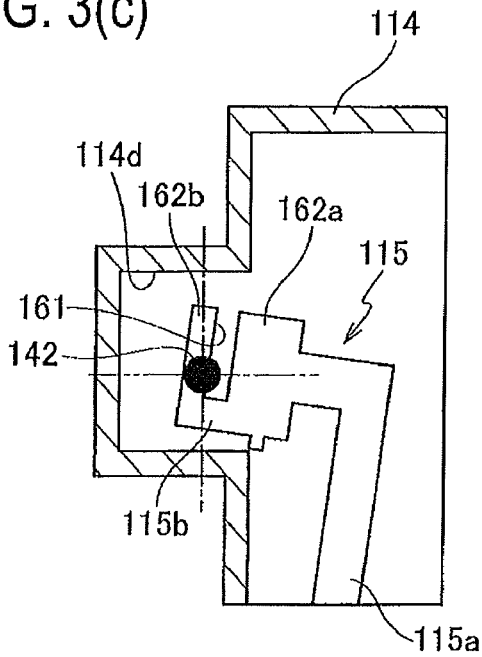
Figure 3D:
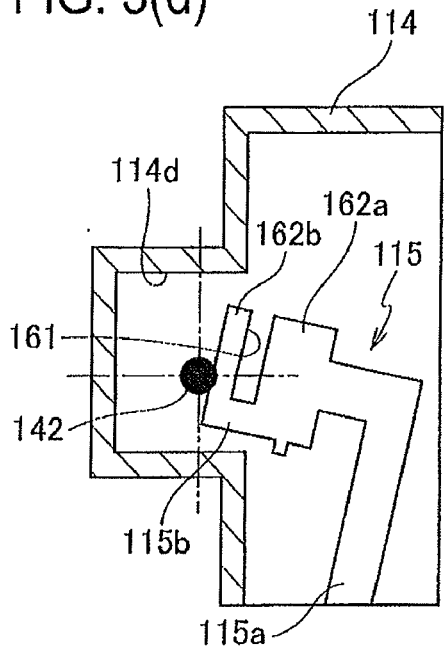

FIGS. 2(*a*) and 2(*b*) are views showing an internal configuration of the ink cartridge 110 and a configuration of the accommodating case 30. In FIGS. 2(*a*) and 2(*b*), the ink cartridge 110 takes a mount attitude in which the ink cartridge 110 is mounted in the accommodating case 30. Note that, in this specification, the attitude of the ink cartridge when mounted in the accommodating case as shown in FIG. 2 is referred to as "mounted attitude". FIG. 2(*b*) is a cross-sectional view taken along a line IIB-IIB in FIG. 2(*a*).

The ink cartridge 110 has a cartridge casing 114 (hereinafter referred to as "casing 114"). The casing 114 is made of a material having light transmissive characteristics, such as a translucent resin material. A hollow ink accommodating chamber 114*c* is formed within the casing 114, and ink 99 is accommodated in the ink accommodating chamber 114*c*. That is, the casing 114 defines the ink accommodating chamber 114*c* (liquid accommodating chamber) that accommodates ink. The casing 114 is formed in a cube shape as a whole. The casing 114 has a convex portion 114*d* protruding leftward therefrom in FIG. 2(*a*). The inner space of the convex portion 114*d* constitutes a portion of the ink accommodating chamber 114*c*.

The ink accommodating chamber 114*c* is in communication with an ink outlet section 39 that allows ink to flow to the outside via a passage 38. An open/close mechanism (not shown) that opens and closes the ink outlet section 39 is provided within the passage 38. This open/close mechanism normally closes the ink outlet section 39, and opens the ink outlet section 39 when the ink outlet section 39 is connected to the ink inlet port 33 of the accommodating case 30.

A remaining-amount detecting mechanism is provided within the ink accommodating chamber 114*c* for detecting residual amounts of liquid 99. The remaining-amount detecting mechanism includes a detection member 115 and a float member 116. The detection member 15 is a plate-shaped member made of a material having light blocking characteristics, and includes an arm section 115*a* and an irradiated section 115*b*. The arm section 115*a* has two corner sections 115*e* and 115*f* at each of which the arm section 115*a* is bent approximately perpendicularly. The irradiated section 115*b* is fixed to an end of the arm section 115*a*, whereas the float member 116 is fixed to the other end. The float member 16 is made of a material of resin or the like, and so configured that its mass per unit volume is smaller than the density of ink 99. For example, the float member 116 may be made of a material of which specific gravity is smaller than ink, or may be formed as a hollow body having a cavity inside if the float member 116 is made of a material of which specific gravity is greater than ink.

The irradiated section 115*b* has generally a square shape. A generally rectangular-shaped slit 161 is formed in the irradiated section 115*b*. The slit 161 extends downward from an upper end of the irradiated section 115*b* to a position close to a lower end of the irradiated section 115*b* in FIG. 2(*a*). Further, the slit 161 is arranged at a position slightly leftward of the center of the irradiated section 115*b* with respect to the left-right direction of FIG. 2. Further, light blocking sections 162*a* and 162*b* are formed such that the slit 161 is interposed between the light blocking sections 162*a* and 162*b*. In the irradiated section 115*b*, the slit 161 is a portion through which light from a light emitting element 31*a* transmits (a portion that directs incident light toward a light receiving element, first section), whereas the light blocking sections 162*a* and 162*b* are portions (second section) that block light from the light emitting element 31*a*.

The arm section 115*a* is pivotably supported by a pivot mechanism. The pivot mechanism is configured of a pivot shaft 117*a* and a bearing (not shown). The pivot shaft 117*a* is fixed to one of the bent corner sections in the arm section 115*a*, i.e., the corner section 115*e*. The pivot shaft 117*a* is pivotably movably supported by the bearing. This configuration allows the arm section 115*a* to pivotally move about the pivot shaft 117*a*. In the present embodiment, the pivot shaft 117*a* is supported at a position close to the lower section of the left inner wall surface of the ink accommodating chamber 114*c*. Further, the position at which the pivot shaft 117*a* is supported is adjusted such that the float member 116 is arranged near the bottom surface within the ink accommodating chamber 114*c* in the up-down direction, and that the irradiated section 115*b* is arranged within the region of the convex portion 114*d* in the ink accommodating chamber 114*c*.

A protruding section 115*d* is formed on the lower end of the irradiated section 115*b*. The protruding section 115*d* makes contact with the convex section 114*d*, thereby restricting the irradiated section 115*b* from moving further below from the position shown in FIG. 2 (restricting mechanism). Thus, when the ink 99 is accommodated in the ink cartridge 110 to the maximum amount, the arm section 115*a* is in a status where the corner section 115*f* is disposed at a position vertically above the corner section 115*e*. The arm section 115*a* and the irradiated section 115*b* are also maintained at a prescribed, from a state where a maximum amount of ink 99 is accommodated within the ink cartridge 110 to a state where the liquid surface of the ink 99 reaches the float member 116. Then, when the liquid surface of ink 99 lowers in a direction R and reaches the float member 116, the float member 116 follows the liquid surface of ink 99 and starts to pivotally move about the pivot shaft 117*a* in a direction Q1. In conjunction with this, the irradiated section 115*b* also moves in a direction Q2. Note that, as described above, the float member 116 is arranged at a position close to the bottom surface of the ink accommodating chamber 114*c*. Accordingly, when the liquid surface of ink 99 moves down and reaches the float member 116, the remaining amount of ink 99 within the ink accommodating chamber 114*c* is small.

Further, the optical sensor section 31 includes a light emitting element 31*a* (light emitting section) and a light receiving element 31*b* (light receiving section). The light emitting element 31*a* and the light receiving element 31*b* are arranged at a position identical to each other with respect to the up-down direction of the drawing. The light emitting element 31*a* is connected to the control section 22 and emits light in accordance with instructions from the control section 22. The light receiving element 31*b* is also connected to the control section 22. When receiving light, the light receiving element 31*b* transmits a signal indicative of an intensity of the received light to the control section 22. As described above, the casing 114 is formed of a material having light transmissive characteristics. Hence, as long as no blocking object exists on a path of the light within the ink accommodating chamber 14*c*, the light from the light emitting element 31*a* reaches the light receiving element 31*b*. However, if light enters in a direction orthogonal to a direction in which thickness of the side walls of the casing 114 extends, the incident light needs to pass inside the side walls, not through the ink accommodating chamber 114*c*, until the light arrives at the light receiving element 31*b*. Hence, if the light enters in the direction orthogonal to the thickness direction of the side walls of the casing 114, the intensity of light becomes fairly small, compared with a case where light enters in a direction parallel to the thickness direction. Note that, instead of making the entirety of the ink cartridge 10 of a material having light transmissive characteristics, windows may be formed in the casing 114 so that light from the light emitting element 31*a* can penetrate the casing 114 through the windows.

As shown in FIG. 2(*b*), in the first embodiment, the light emitting element 31*a* and the light receiving element 31*b* are arranged such that the convex section 114*d* is interposed between the light emitting element 31*a* and the light receiving element 31*b*. Thus, light 141 emitted from the light emitting element 31*a* can arrive at the light receiving element 31*b* through the convex section 114*d*.

Hence, as shown in FIG. 2(*a*), a position through which emitted light from the light emitting element 31*a* passes is located within the convex section 114*d* (hereinafter, this position is referred to as "detection position"). That is, the detection position 142 is a position interposed between the light emitting element 31*a* and the light receiving element 31*b* when the ink cartridge 110 is mounted in the accommodating case 130.

With the above-described configuration, the position of the irradiation member 115*b* changes in response to amounts of ink remaining within the ink accommodating chamber 114*c*. For example, when the remaining amount of ink is a certain amount, the light blocking section 162*a* or the light blocking section 162*b* is located at the detection position 142 in the ink accommodating chamber 14*c*. In contrast, when the remaining amount of ink is another amount, the slit 161 comes to the detection position 142. When either the light blocking section 162*a* or the light blocking section 162*b* is located at the detection position 142, light from the light emitting element 31*a* reaches the light receiving element 31*b*. Accordingly, the intensity of light received by the light receiving element 31*b* when the slit 161 is located at the detection position 142 is greater than the intensity of light received by the light receiving element 31*b* when the either one of the light blocking sections 162*a* and 162*b* is located at the detection position.

Hereinafter is an explanation on how the light received by the light receiving element 31*b* changes in response to the residual amounts of ink 99. First, changes in the intensity of light are explained if the ink cartridge 110 has been in use from when the ink cartridge 110 was mounted until the ink 99 becomes empty. Next, changes in the intensity of light when the link cartridge 110 is being mounted or dismounted.

If the ink cartridge 110 has been continuously used until the internal ink 99 becomes empty from the time of being mounted, the intensity of light received by the light receiving element 31*b* changes as follows in accordance with decrease of the ink within the ink accommodating chamber 114*c*. FIG. 3 is an enlarged view of a region enclosed by a single-dot chain line of FIG. 2(*a*). FIG. 3(*a*) shows a state before the liquid surface of ink 99 reaches the float member 116. FIG. 3(*b*) shows a state after the liquid surface of ink 99 has lowered and reached the float member 116, and the irradiated section 115*b* has moved a little in the direction Q2 of FIG. 3(*a*) from the position of FIG. 4(*a*). FIG. 3(*c*) shows a state after the liquid surface of ink 99 has lowered, and the irradiated section 115*b* has further moved from the position of FIG. 3(*b*). FIG. 3(*d*) shows a state after the liquid surface of ink 99 has lowered, and the irradiated section 115*b* has further moved from the position of FIG. 3(*c*).

The state of the irradiated section 115*b* changes depending on the amounts of ink 99 left within the ink cartridge 110, as described below. In FIG. 3(*a*), the irradiated section 115*b* is in a state where the light blocking section 162*a* is located at the detection position 142. In FIG. 3(*b*), the irradiated section 115*b* is in a state where the slit 161 is located at the detection position 142. In FIG. 3(*c*), the irradiated section 115*b* is in a state where the light blocking section 162*b* is located at the detection position 142. In FIG. 3(*d*), the irradiated section 115*b* is in a state where the irradiated section 115*b* has finished moving past the detection position 142 and is located at a position rightward of the detection position 142. In this way, the irradiated section 115*b* moves from the left to the right of FIG. 3 in response to the decrease in the ink 99.

Figure 4:
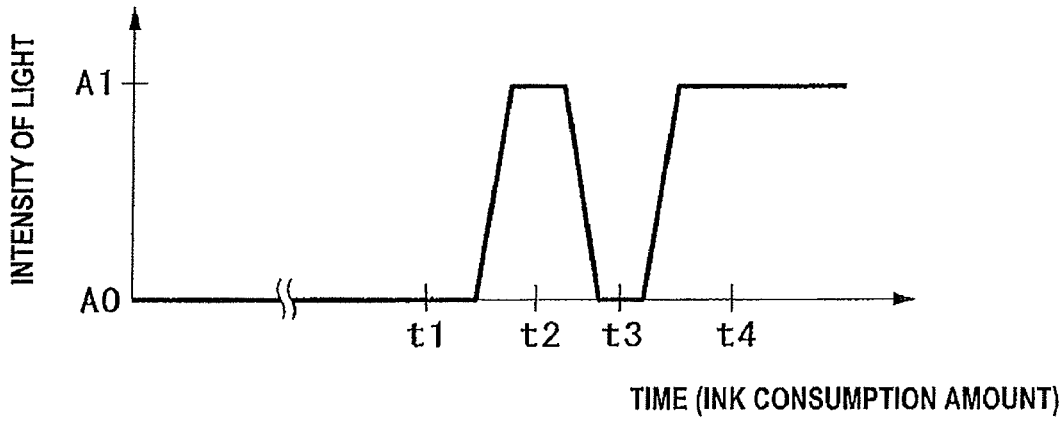
[FIG. 4] A graph showing intensity of light that an optical sensor section detects in accordance with a decrease in the amount of ink in the ink cartridge according to the first embodiment.

FIG. 4 shows changes in the intensity of light received by the light receiving element 31*b* when the irradiation range of light changes as shown in from FIG. 3(*a*) to FIG. 3(*d*). The horizontal axis of FIG. 4 represents time (and the consumption amount of ink 99), whereas the vertical axis represents the intensity of light. A light intensity A1 indicates the intensity in a case where light from the light emitting element 31*a* reaches the light receiving element 31*b* without being blocked by the detection member 115. A light intensity A0 indicates the intensity in a case where light from the light emitting element 31*a* reaches the light receiving element 31*b* when blocked by the detection member 115. Time t1-t4 respectively correspond to time when the irradiated section 115*b* is in each state of FIGS. 3(*a*)-3(*d*).

At t1, because light is blocked by the light blocking section 162*a*, the intensity of light received by the light receiving element 31*b* is A0. At t2, because light is received by the light receiving element 31*b* through the slit 161, the intensity of light received by the light receiving element 31*b* is A1. At t3, because light is blocked by the light blocking section 162*b*, the intensity of light received by the light receiving element 31*b* is A0. At t4 and thereafter, because the irradiated section 115*b* has finished moving past the detection position 142, the intensity of light is A1.

As described above, according to the first embodiment, when the ink 99 within the ink accommodating chamber 114*c* decreases to a small amount, the liquid surface of ink 99 reaches the float member 116, and the float member 116 begins to move. As the ink 99 further decreases, the position of the detection member 115 sequentially changes in conjunction with the float member 116, from a first position where the light blocking section 162*a* is located at the detection position 142, to a second position where the slit 161 is located at the detection position 142, then to a third position where the light blocking section 162*b* is located at the detection position 142, and finally to a fourth position where the irradiated section 115*b* has finished moving past the detection position 142. Simultaneously, the status of light received by the light receiving element 31*b* sequentially changes from a first state where the intensity is A0, to a second state where the intensity is A1, to a third state where the intensity is A0, and finally to a fourth state where the intensity is A1.

The control section 22 acquires which of the first through fourth states the current status corresponds to, thereby identifying how much amount of ink 99 is left in four stages. Specifically, the control section 22 counts how many times the status of light received by the light receiving element 31*b* switches between the light intensity A0 and the light intensity A1. Then, depending on the switched number of times being 0-3 times, the present status is determined to be any one of the first through fourth states. Then, based on the determined result on the residual amount of ink 99, the control section 22 notifies the user of information indicating the remaining amount of ink 99 via the notifying section 29. For example, in accordance with each of the first through fourth states, a message may be shown on the display, wherein the message may inform that the remaining amount of ink 99 is still sufficient, the remaining amount of ink 99 is small, the remaining amount of ink 99 is further small, or the remaining amount of ink 99 is nearly empty.

Figure 5:
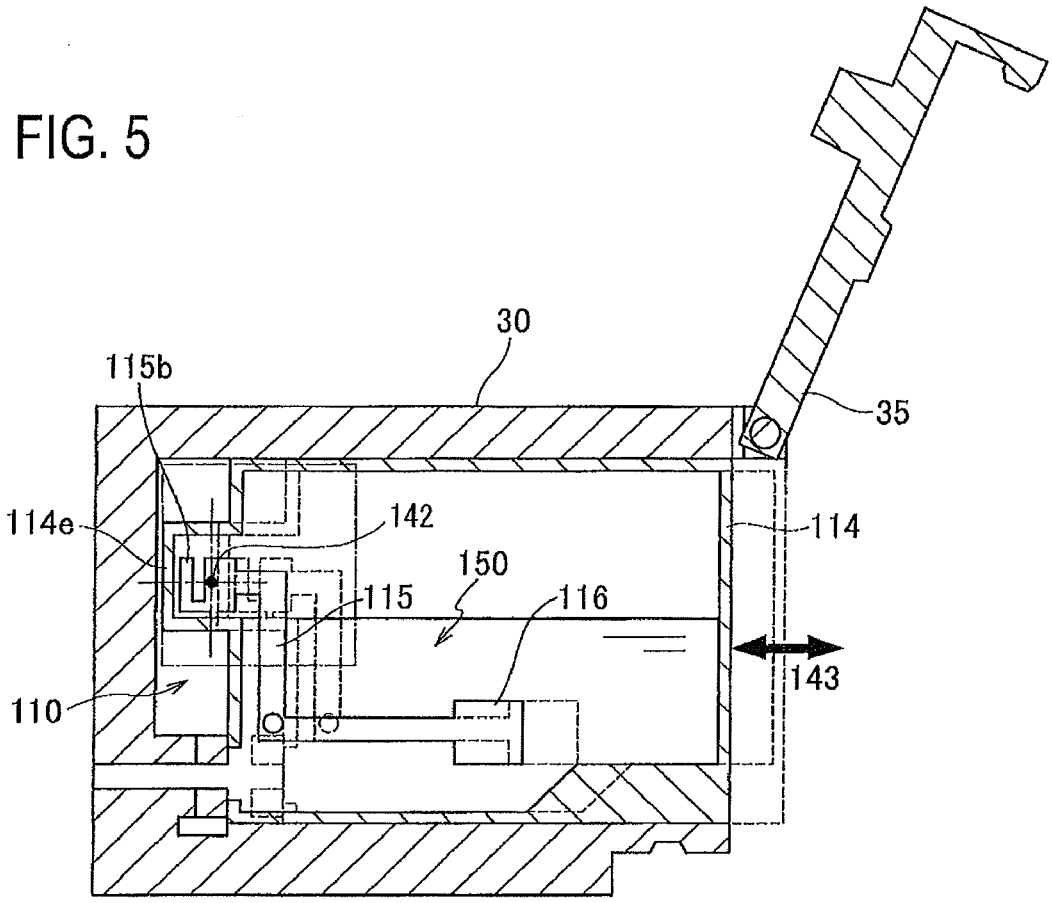
[FIG. 5] A cross-sectional view showing a state in which the ink cartridge according to the first embodiment is being mounted in or dismounted from the printer.

The ink cartridge 110 has a configuration that allows the amount of ink 99 left in the ink cartridge 110 to be detected, not only when the ink cartridge 110 continues to be in the mounted attitude until present from when the ink cartridge 110 was first used, but also when the ink cartridge 110 is being mounted in or dismounted from the accommodating case 30 during in use. FIG. 5 shows a state where the ink cartridge 110 is being mounted in or dismounted from the accommodating case 30. Broken lines represent a state of the ink cartridge 110 slid slightly rightward from the mounted attitude. When the ink cartridge 110 is being mounted in the accommodating case 30, the ink cartridge 110 moves to the mounted attitude via a position indicated by the broken lines. At this time, the detection position 142 moves relative to the irradiated section 115*b* such that the detection position 142 cuts across the irradiated section 115*b* along a direction parallel to a direction 143, for example.

Note that, the casing 114 is made of a material having light transmissive characteristics, as described above. Therefore, light emitted from the light emitting element 31*a* enters the ink accommodating chamber 114*c* via the casing 114. However, if a left side wall 114*e* of the casing 114 is located at the detection position 142, incident light from the light emitting element 31*a* enters in the direction perpendicular to the thickness direction of the left side wall 114*e* (left-right direction of FIG. 5). Hence, the intensity of light received by the light receiving element 31*b* becomes dramatically smaller if the left side wall 114*e* is located at the detection position 142, compared with states before and after this case.

Figure 6A:
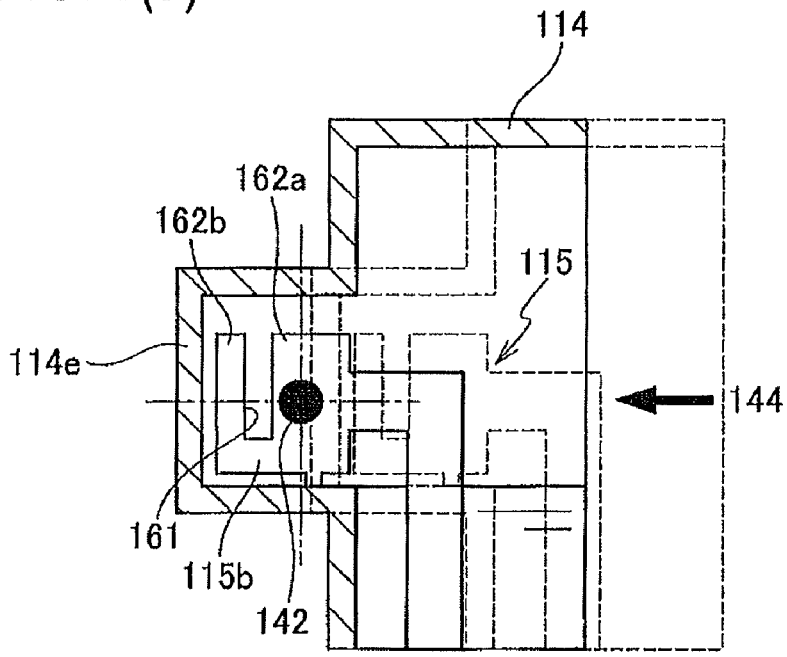
[FIG. 6] (*a*) is a partial enlarged view of FIG. 5 showing a state where the ink cartridge according to the first embodiment is being mounted in or dismounted from the printer when substantial amount of ink remains in the ink cartridge, and (b) is a graph showing intensity of light that a light receiving element receives in the state of (a)
Figure 6B:
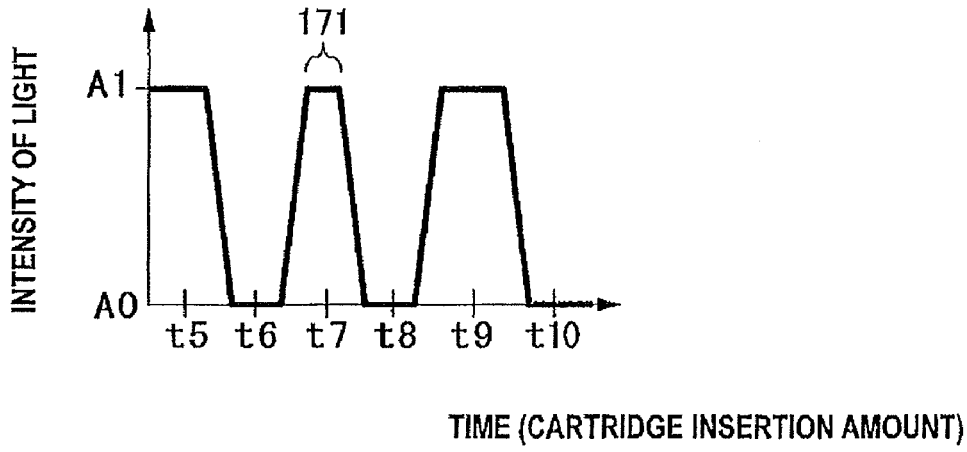
Figure 7A:
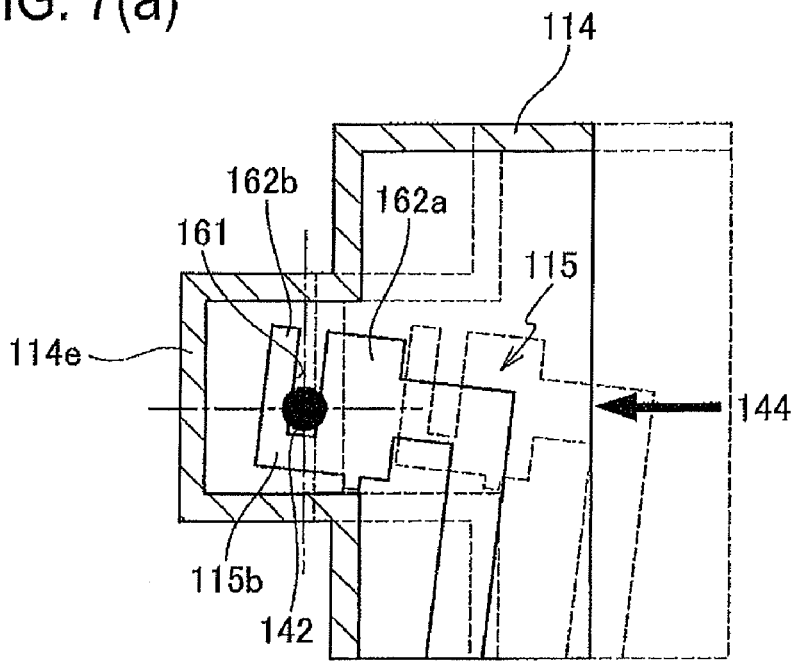
[FIG. 7] (*a*) is a partial enlarged view of FIG. 5 showing a state where the ink cartridge according to the first embodiment is being mounted in or dismounted from the printer when smaller amount of ink remains in the ink cartridge, and (b) is a graph showing intensity of light that the light receiving element receives in the state of (a)
Figure 7B:
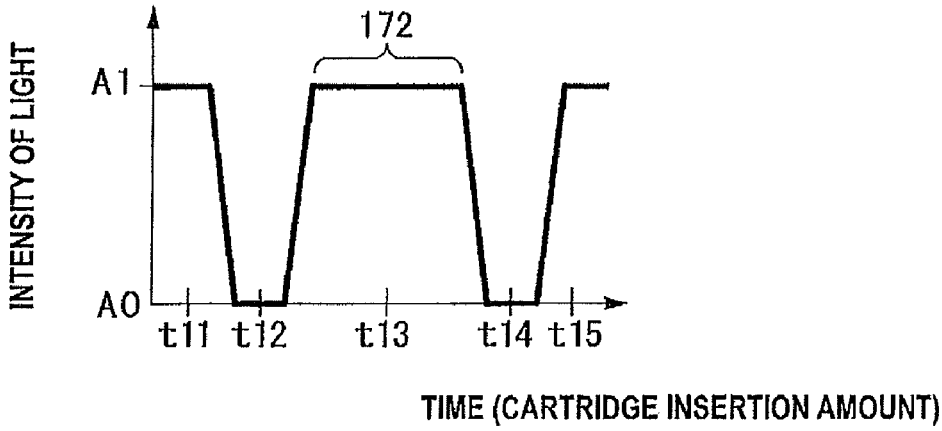
Figure 8A:
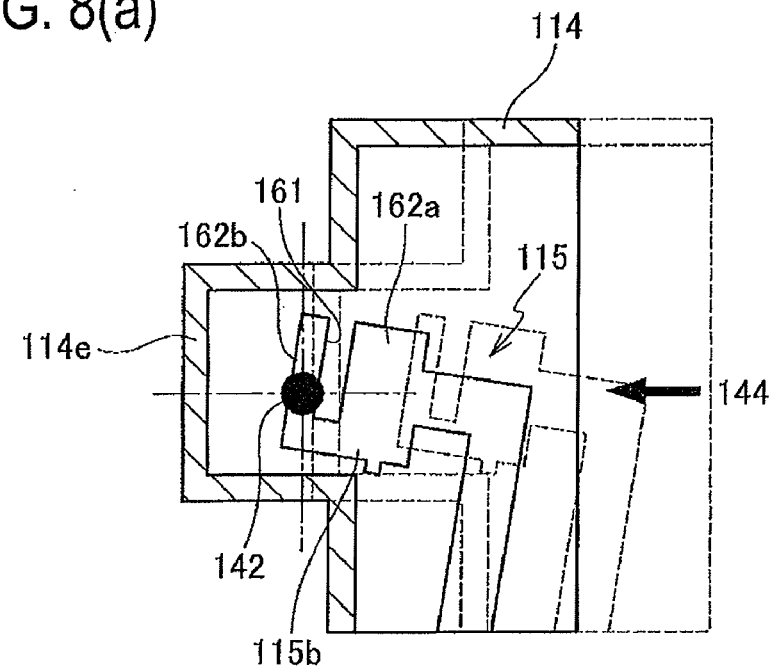
[FIG. 8] (*a*) is a partial enlarged view of FIG. 5 showing a state where the ink cartridge according to the first embodiment is being mounted in or dismounted from the printer when even smaller amount of ink is left in the ink cartridge, (b) is a graph showing intensity of light that the light receiving element receives in the state of (a)
Figure 8B:
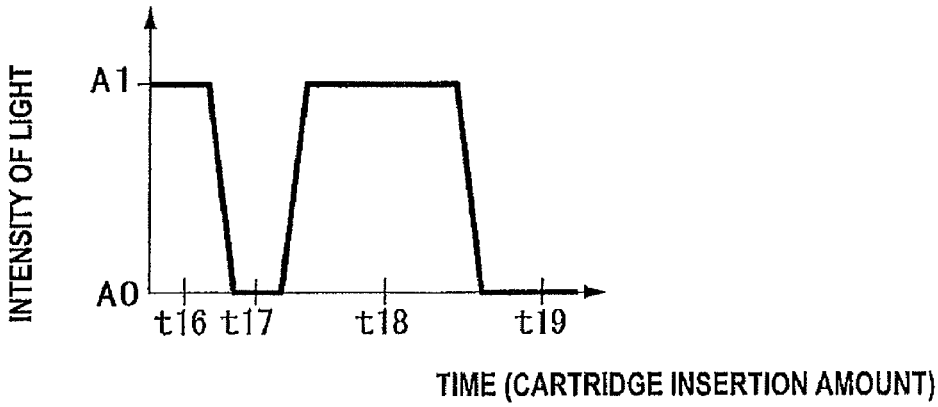
Figure 9A:
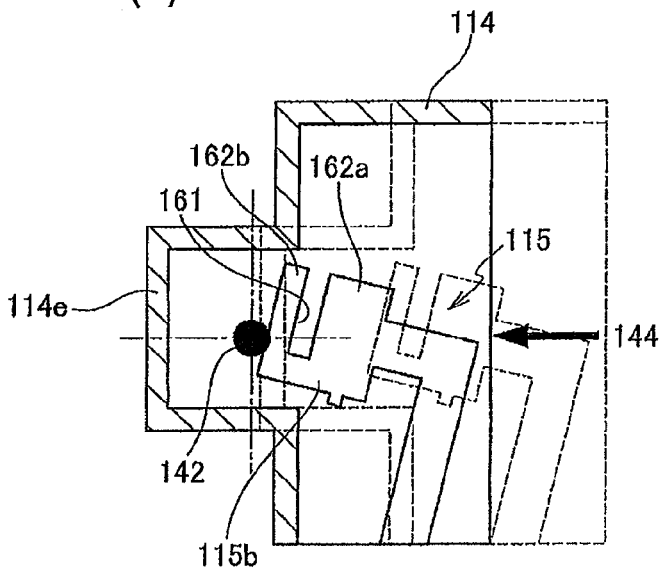
[FIG. 9] (*a*) is a partial enlarged view of FIG. 5 showing a state where the ink cartridge according to the first embodiment is being mounted in or dismounted from the printer when almost no ink remains in the ink cartridge, and (b) is a graph showing intensity of light that the light receiving element receives in the state of (a)

FIG. 6(*a*), FIG. 7(*a*), FIG. 8(*a*), and FIG. 9(*a*) are enlarged views of a region enclosed by a single-dot chain line in FIG. 5. FIG. 6(*a*), FIG. 7(*a*), FIG. 8(*a*), and FIG. 9(*a*) show respective states in which the detection position 142 moves relative to the irradiated section 115*b* when the ink cartridge 110 having a different remaining amount of ink 99 is mounted in the accommodating case 30 along an arrow 144. The remaining amounts of ink 99 in FIG. 6(*a*), FIG. 7(*a*), FIG. 8(*a*) and FIG. 9(*a*) correspond to the remaining amounts of ink 99 in FIG. 3(*a*) through FIG. 3(*d*). In FIG. 6(*a*), FIG. 7(*a*), FIG. 8(*a*) and FIG. 9(*a*), solid lines indicate the ink cartridge 110 in the mounted attitude, while broken lines indicate the ink cartridge 110 immediately before the ink cartridge 110 takes the mounted attitude. Further, FIG. 6(*b*), FIG. 7(*b*), FIG. 8(*b*), and FIG. 9(*b*) are graphs that represent changes in the intensity of light received by the light receiving element 31*b* when the detection position 142 moves relative to the irradiated section 115*b* as shown in FIG. 6(*a*), FIG. 7(*a*), FIG. 8(*a*) and FIG. 9(*a*), respectively.

In case of FIG. 6(*a*), the intensity of light received by the light receiving element 31*b* changes as shown in FIG. 6(*b*). First, prior to a state shown by the broken lines in FIG. 6(*a*), light from the light emitting element 31*a* is received by the light receiving element 31*b* without being blocked. At this time, the intensity of light is A1 (t5). Next, when the detection position 142 reaches the left side wall 114*e* of the ink cartridge 110 (the left-side side wall section of the convex section 114*d*), the path of light is blocked by the left side wall 114*e*. At this time, the intensity of light is A0 (t6). Next, when the detection position 142 has finished moving past the left side wall 114*e*, the path of light is formed in a space between the left side wall 114*e* and the irradiated section 115*b*, and thus the intensity of light is A1 (t7). Next, after the detection position 142 reaches the irradiated section 115*b*, the detection position 142 moves past the light blocking section 162*b* and the slit 161 sequentially. Accordingly, the intensity of light once changes to A0 (t8), and thereafter becomes A1 (t9). Next, when the detection position 142 moves past the slit 161 and reaches the light blocking section 162*b*, the intensity of light becomes A0 (t10). Then, in the mounted attitude shown by the solid lines in FIG. 6(*a*), the light blocking section 162*a* is at the detection position 142. The intensity of light therefore becomes A0 at t10 and thereafter.

In case of FIG. 7(*a*), the intensity of light received by the light receiving element 31*b* changes as shown in FIG. 7(*b*). First, prior to a state shown by the broken lines in FIG. 7(*a*), light from the light emitting element 31*a* is received by the light receiving element 31*b* without being blocked. At this time, the intensity of light is A1 (t11). Next, when the detection position 142 reaches the left side wall 114*e* of the ink cartridge 110, the path of light is blocked by the left side wall 114*e*. At this time, the intensity of light is A0 (t12). Next, when the detection position 142 has finished moving past the left side wall 114*e*, the path of light is formed in a space between the left side wall 114*e* and the irradiated section 115*b*, and thus the intensity of light is A1 (t13). Next, when the detection position 142 reaches the irradiated section 115*b*, the detection position 142 moves past the light blocking section 162*b* and relatively moves to the slit 161. Accordingly, the intensity of light once changes to A0 (t14), and thereafter becomes A1 (t15). Here, in the mounted attitude shown by the solid lines in FIG. 7(*a*), the slit 161 is at the detection position 142, and therefore the intensity of light is A1 at t15 and thereafter.

In case of FIG. 8(*a*), the intensity of light received by the light receiving element 31*b* changes as shown in FIG. 8(*b*). First, prior to a state shown by the broken lines in FIG. 8(*a*), light from the light emitting element 31*a* is received by the light receiving element 31*b* without being blocked. At this time, the intensity of light is A1 (t16). Next, when the detection position 142 reaches the left side wall 114*e* of the ink cartridge 110, the path of light is blocked by the left side wall 114*e*. At this time, the intensity of light is A0 (t17). Next, when the detection position 142 has finished moving past the left side wall 114*e*, the path of light is formed in a space between the left side wall 114*e* and the irradiated section 115*b*, and thus the intensity of light is A1 (t18). Then, when the detection position 142 reaches the light blocking section 162*b*, the intensity of light becomes A0 (t19). Here, in the mounted attitude shown by the solid lines in FIG. 8(*a*), the light blocking section 162*b* is located at the detection position 142. Accordingly, the intensity of light is A0 at t19 and thereafter.

In case of FIG. 9(*a*), the intensity of light received by the light receiving element 31*b* changes as shown in FIG. 9(*b*). First, prior to a state shown by the broken lines in FIG. 9(*a*), light from the light emitting element 31*a* is received by the light receiving element 31*b* without being blocked. At this time, the intensity of light is A1 (t20). Next, when the detection position 142 reaches the left side wall 114*e* of the ink cartridge 110, the path of light is blocked by the left side wall 114*e*. At this time, the intensity of light is A0 (t21). Next, when the detection position 142 has finished moving past the left side wall 114*e*, the path of light is formed in a space between the left side wall 114*e* and the irradiated section 115*b*, and thus the intensity of light is A1 (t22). Here, in the mounted attitude shown by the solid lines in FIG. 9(*a*), the detection position 142 is located between the irradiated section 115*b* and the left side wall 114*e*. Accordingly, the intensity of light is A0 at t21 and thereafter.

As described above, when the ink cartridge 110 is being mounted in the accommodating case 30, the intensity of light received by the light receiving element 31*b* shows different changes in patterns depending on the amount of ink 99 left in the mounted ink cartridge 110, as shown in FIG. 6(*b*), FIG. 7(*b*), FIG. 8(*b*) and FIG. 9(*b*).

Hence, the control section 22 acquires the remaining amount of ink 99 within the ink cartridge 110 when the ink cartridge 110 is mounted in the accommodating case 30, based on signals from the light receiving element 31*b*. Specifically, for example, the control section 22 includes a memory for storing data indicative of the patterns of change of the light intensity such as those shown in FIG. 6(*b*), FIG. 7(*b*), FIG. 8(*b*), and FIG. 9(*b*), in association with the remaining amounts of ink 99 corresponding to the respective patterns of change. The control section 22 determines which of the changing patterns stored in the memory corresponds to the changes in the light intensity indicated by the signal from the light receiving element 31*b*, and acquires the remaining amount of ink 99 from the determined results.

In this embodiment, depending on each case of FIG. 6(*b*), FIG. 7(*b*), FIG. 8(*b*) and FIG. 9(*b*), whether the detection position 142 moves past the slit 161, the light blocking sections 162*a*, and the light blocking section 162*b* is different from each other. Hence, from when the detection position 142 moves past the left side wall 114*e* until when the ink cartridge 110 is in the mounted attitude, how many times the intensity of light received by the light receiving element 31*b* becomes A0 and how many times the intensity of light received by the light receiving element 31*b* becomes A1 are different from each other, depending on each case of FIG. 6(*b*), FIG. 7(*b*), FIG. 8(*b*) and FIG. 9(*b*). Following table 1 shows the number of times the intensity of light received by the light receiving element 31*b* becomes A0 and the number of times the intensity of light received by the light receiving element 31*b* becomes A1 in respective cases. Note that, respective time to be A0 or A1 is shown in parentheses. In Table 1, the number of times the intensity of light received by the light receiving element 31*b* becomes A1 corresponds to a number which is obtained by adding 1, i.e., the path of light is once formed in the space between the irradiated section 115*b* and the left side wall 114*e*, to the number of times the irradiated light moves past the slit 161. In Table 1, the number of times the intensity of light received by the light receiving element 31*b* becomes A0 corresponds to the number of times the irradiated light from the light emitting element 31*a* is blocked by the light blocking sections 162*a* and 162*b*.

TABLE 1

Figure 9B:
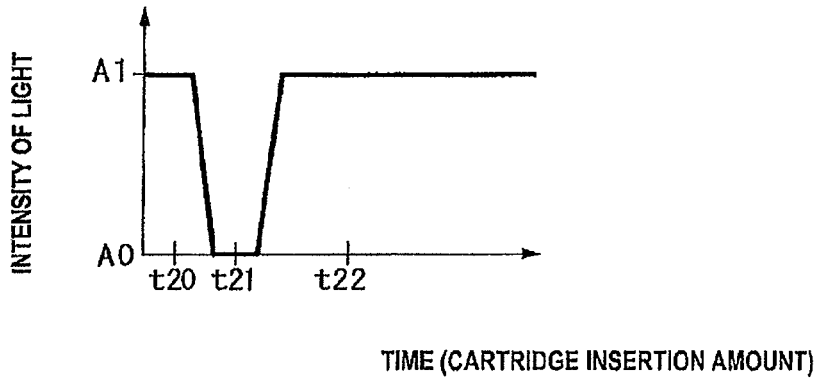

| | Number of times of A0 (time) | Number of times of A1 (time) |
|---|---|---|
| FIG. 6(b) | 2 times(t8, t10) | 2 times(t7, t9) |
| FIG. 7(b) | 1 time(t14) | 2 times(t13, t15) |
| FIG. 8(b) | 1 time(t19) | 1 time(t18) |
| FIG. 9(b) | 0(—) | 1 time(t22) |

The control section 22 stores data showing the Table 1 in the memory. Meanwhile, the control section 22 acquires the number of times the intensity of light received by the light receiving element 31*b* becomes A0 or A1, based on the signals from the light receiving element 31*b*. The control section 22 can detect which case among FIG. 6(*b*) through FIG. 9(*b*) corresponds to the residual amount of ink in the mounted link cartridge 110 by comparing the acquired number of times with the data stored in the memory. Then, the control section 22 informs the user of the detected remaining amount of ink 99 via the notifying section 29. For example, depending on respective patterns of change shown in FIG. 6(*b*) through FIG. 9(*b*), a message may be shown on the display. The message may be such that the amount of ink 99 left in the mounted ink cartridge 110 is still sufficient, a replacement cartridge is necessary to be prepared since a smaller amount of ink 99 is left, the remaining amount of ink 99 will soon be empty, or the remaining amount mount of ink 99 is nearly empty, depending on the residual amounts of ink 99.

Note that, in the first embodiment, the remaining amount of ink 99 can be known in at least four stages while the ink cartridge 110 is being mounted, as shown in FIG. 6. However, the remaining amount of ink 99 can be grasped in more than four stages. For example, as shown in FIG. 6(*a*) and FIG. 7(*a*), a distance by which the irradiated section 115*b* and the casing 114 are separated is different depending on the remaining amounts of ink 99. Accordingly, as shown in FIG. 6(*b*) and FIG. 7(*b*), lengths of a time period 171 and a time period 172 during which the intensity of light remains A1 are different from each other. Based on this difference, the remaining amount of ink 99 can be grasped in more than or equal to five stages in total, by determining that the remaining amount of ink 99 is smaller as the time period 172 is longer.

The above description explains a case in which the remaining amount of ink 99 is acquired when the ink cartridge 110 is being mounted. However, when the ink cartridge 110 is dismounted from the accommodating case 30, the number of times the intensity of light received by the light receiving element 31*b* becomes A0 or A1 is identical to the respective cases when the ink cartridge 110 is being mounted. Hence, the remaining amount of ink 99 can also be grasped when the ink cartridge 110 is dismounted from the accommodating case 30.

Further in the present embodiment, the irradiated section 115*b* is disposed at a position substantially vertically above the pivot shaft 117*a* when the ink 99 is sufficiently accommodated in the ink accommodating chamber 114*c* (refer to FIG. 2). Accordingly, the ink 99 reaches the float member 116 and the arm section 115*a* starts to pivotally move, the irradiated section 115*b* moves substantially rightward in FIG. 2. The irradiated section 115*b* continues to be located generally above the pivot shaft 117*a* until the ink 99 comes almost empty (refer to FIG. 9(*a*)). Hence, the irradiated section 115*b* moves, with respect to the mounting direction of the ink cartridge 110, from forward (leading side; leftward in FIG. 2) to rearward (trailing side; rightward in FIG. 2), in accordance with the decrease in the ink 99. That is, positions of the slit 161, the light blocking section 162*a* and the light blocking section 162*b* can reliably change in response to the remaining amounts of ink with respect to the mounting direction. In this way, the number of times intensity of light received by the light receiving element 31*b* becomes A0 or A1 can reliably change in accordance with the residual amounts of ink, thereby facilitating detection of the remaining amounts of ink.

Further, the slit 161 and the light blocking sections 162*a* and 162*b* are arranged alternately with respect to the mounting direction in the irradiated section 115*b*. Because the irradiated section 115*b* moves substantially in the mounting direction, the alternating arrangement of the slit 161 and the light blocking sections 162*a* and 162*b* can be maintained in the mounting direction regardless of the residual amounts of ink 99. Hence, the slit 161 and the light blocking sections 162*a* and 162*b* can be reliably dislocated with respect to the mounting direction in accordance with the decrease in the ink 99, and therefore the number of times the intensity of light received by the light receiving element 31*b* becomes A01 or A1 can reliably change in response to the remaining amounts of ink.

Further, in the first embodiment, the slit 161 is formed in the irradiated section 115*b* so as to extend along the up-down direction thereof. Therefore, the slit 161 can reliably deform relative to the detection position 142 in the mounting direction.

Second Embodiment

Figure 10:
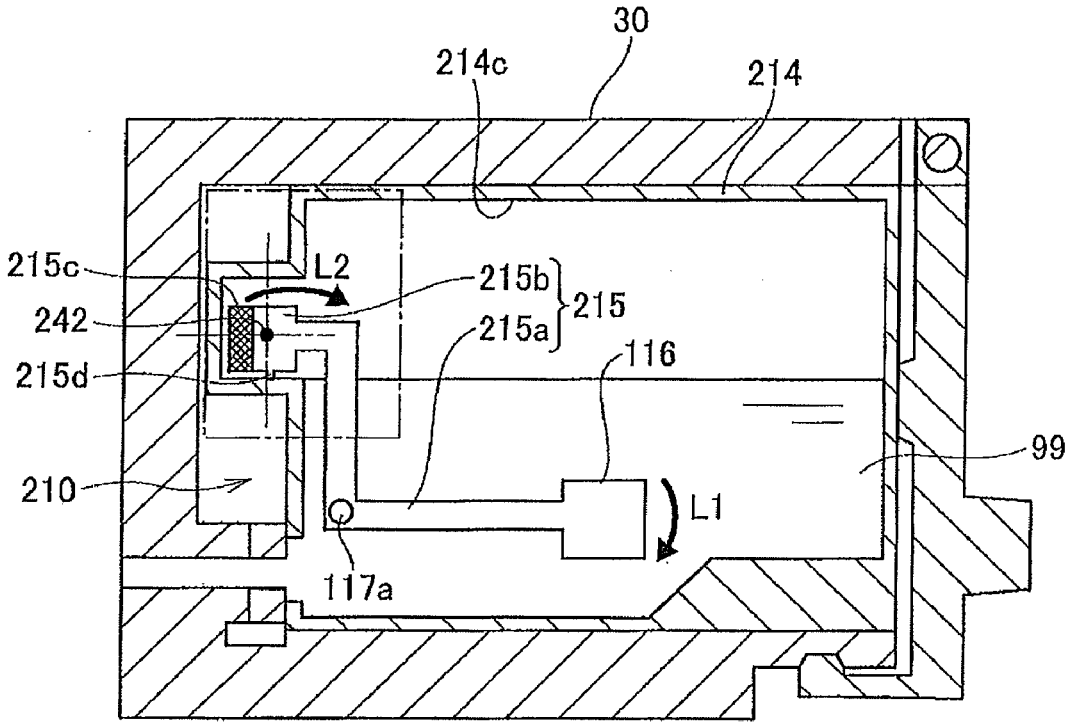
[FIG. 10] A cross-sectional view showing a detailed configuration around an ink cartridge according to a second embodiment.

Hereinafter is a description of a second embodiment of the present invention. In the following description, explanations for configurations the same as those of the first embodiment are omitted. Also, for the configurations identical to those in the first embodiment, the same reference numerals are provided. FIG. 10 is a view showing a configuration of an ink cartridge 210 according to the second embodiment and the accommodation case 30.

The ink cartridge 210 includes a detection member 215 and a float member 116 each constituting a remaining amount detecting mechanism. The detection member 215 includes an arm section 215*a* and an irradiated section 215*b*. The arm section 215*a* is a plate-shaped member that is bent twice approximately at a right angle, just like the arm section 115*a*. The irradiated section 215*b* is fixed to one end of the arm section 215*a*, whereas the float member 116 is fixed to the other end. A pivot shaft 117*a* is fixed to lower one of the bent corner sections of the arm section 215*a*. The position at which the pivot shaft 117*a* is supported by the ink cartridge 210 is adjusted such that the float member 116 fixed to the other end of the arm section 215*a* comes to a position near the bottom surface within an ink accommodating chamber 214*c*. The irradiated section 215*b* includes a slit-formed section 215*c* in which fine slits are formed. The slit-formed section 215*c* is arranged at the left end of the irradiated section 215*b* in FIG. 10, and has a band-like zone spanning from the upper end to the lower end of the irradiated section 215*b*.

Further, a protruding section 215*d* is formed at the lower end of the irradiated section 215*b*. The protruding section 215*d* contacts a casing 214 of the ink cartridge 210, thereby restricting the movement of the irradiated section 215*b* so that the irradiated section 215*b* does not move lower than a position shown in FIG. 10. Hence, the irradiated section 215*b* is held at a prescribed position from a state where the ink 99 is accommodated within the ink cartridge 210 to the maximum amount to a state where the liquid surface of ink 99 reaches the float member 116. When the liquid surface of ink 99 moves down to reach the float member 116, the float member 116 follows the liquid surface of ink 99 and moves in a direction L1. In conjunction with this, the irradiated section 215*b* also moves in a direction L2. Note that, as described above, the float member 116 is arranged a position near the bottom surface of the ink accommodating chamber 214*c*. Accordingly, if the liquid surface of ink 99 moves down to reach the float member 116, the remaining amount of ink 99 within the ink accommodating chamber 214*c* becomes small.

Figure 11A:
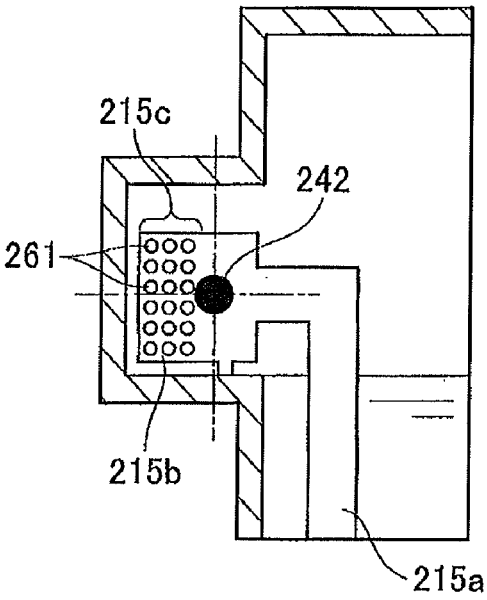
[FIG. 11] Partial enlarged views of FIG. 10 showing positions of a remaining-amount detecting member in response to amounts of ink remaining in the ink cartridge according to the second embodiment, wherein (a) shows a position of the remaining-amount detecting member when the remaining amount of ink is nearly at a maximum amount, (b) shows a position of the remaining-amount detecting member when the remaining amount of ink becomes less than the maximum amount, and (c) shows a position of the remaining-amount detecting member when the remaining amount of ink becomes even smaller.
Figure 11B:
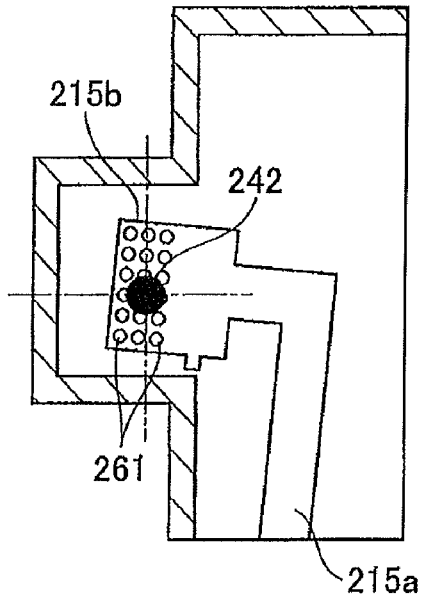
Figure 11C:
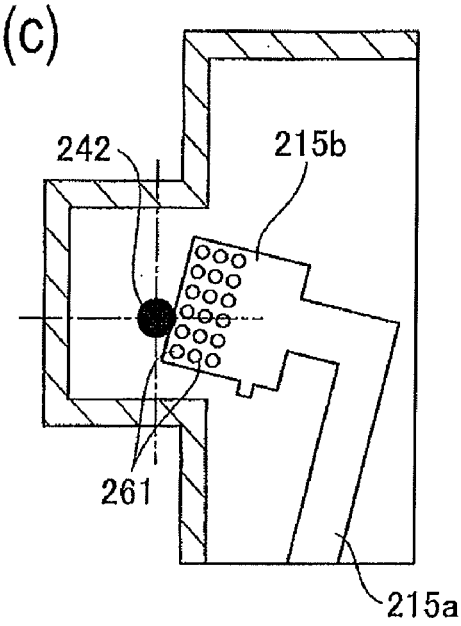

FIG. 11 is an enlarged view of an area enclosed by a single-dot chain line in FIG. 10, and shows how the irradiated section 215*b* changes its positions when the ink cartridge 210 is continued to be used in the mounted attitude. FIG. 11(*a*) shows a state before the liquid surface of ink 99 reaches the float member 116. FIG. 11(*b*) shows a state after the liquid surface of ink 99 has moved down to reach the float member 116, and the irradiated section 215*b* has moved slightly from the position of FIG. 10 in the direction L2. FIG. 11(*c*) shows a state after the liquid surface of ink 99 has moved down, and the irradiated section 215*b* has further moved from the position of FIG. 11(*b*). Note that, in the second embodiment, a reference number 242 indicates a range onto which light from the light emitting element 31*a* provided in the printer 20 is irradiated.

As shown in FIG. 11, a plurality of slits 261 is formed in the slit-formed section 215*c*. The slit 261 penetrates the irradiated section 215*b* in the thickness direction, and has a circular shape in a cross-section perpendicular to the thickness direction. The slits 261 are arranged in a lattice shape so that the slits 261 can be distributed evenly in the zone from the upper end to the lower end of the left half of the irradiated section 215*b* in FIG. 11. Light irradiated on the slit-formed section 215*c* moves past the irradiated section 215*b* via the slits 261. These slits 261 are formed such that the diameters of the slits 261 are smaller than the diameter of the irradiation range 242 of light, and that the distances between the slits 261 are smaller than the diameter of the irradiation range 242 on average.

The position of the irradiation range 242 relative to the irradiated section 215*b* changes in response to the amounts of ink 99 within the ink cartridge 210, as described below. In the state of FIG. 11(*a*), the irradiation range 242 is located in a region other than the slit-formed section 215*c* in the irradiated section 215*b*. In the state of FIG. 11(*b*), the irradiation range 242 is located within the region of the slit-formed section 215*c*. In the state of FIG. 11(*c*), the irradiation range 242 is located outside the region of the irradiated section 215*b*.

Figure 12:
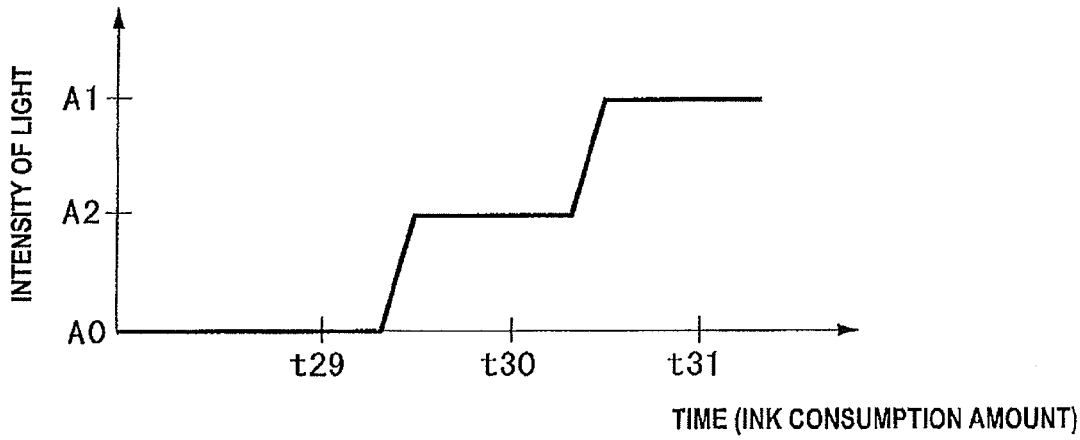
[FIG. 12] A graph showing intensity of light that an optical sensor section detects in accordance with a decrease in the amount of ink in the ink cartridge according to the second embodiment.

FIG. 12 shows changes in the intensity of light received by the light receiving element 31*b* as the irradiation range of light changes from FIG. 11(*a*) to FIG. 11(*c*). The horizontal axis of FIG. 12 represents time (and the consumption amount of ink 99), whereas the vertical axis represents the intensity of light. Time t29-t31 correspond to time when the irradiated section 215*b* is in the respective states of FIG. 11(*a*) through FIG. 11(*c*).

At t29, when the irradiation range 242 is located in the region other than the slit-formed section 215*c* in the irradiated section 215*c*, light is blocked by the irradiated section 215*b* and thus the light received by the light receiving element 31*b* is A0. At t31, because the light is received by the light receiving element 31*b* without passing the irradiated section 215*b*, the intensity of light received by the light receiving element 31*b* is A1. At t30, when the irradiation range 242 is located within the range of the slit-formed section 215*c*, light moves past the irradiated section 215*b* via at least one of the slits 261. On the other hand, because the slits 261 are smaller than the irradiation range 242, the irradiation range 242 includes a region where the slits 261 are not opened. Accordingly, part of light irradiated on the irradiation range 242 is blocked by the region where the slits 261 are not opened. Hence, intensity A2 of light received by the light receiving element 31*b* at t30 is greater than A0 at t29 and is smaller than A1 at t31.

As described above, according to the second embodiment, the intensity of light received by the light receiving element 31*b* changes twice as the remaining amount of ink 99 becomes small. Hence, the remaining amount of ink 99 can be grasped in three stages by counting how many times the intensity of light has changed by the present time. Or alternatively, since the intensity of light changes in three stages of A0, A1, and A2, the remaining amount of ink 99 can be grasped in three stages by determining current intensity of light to be any one of A0-A2, without counting the number of changes in the intensity of light.

Figure 13:
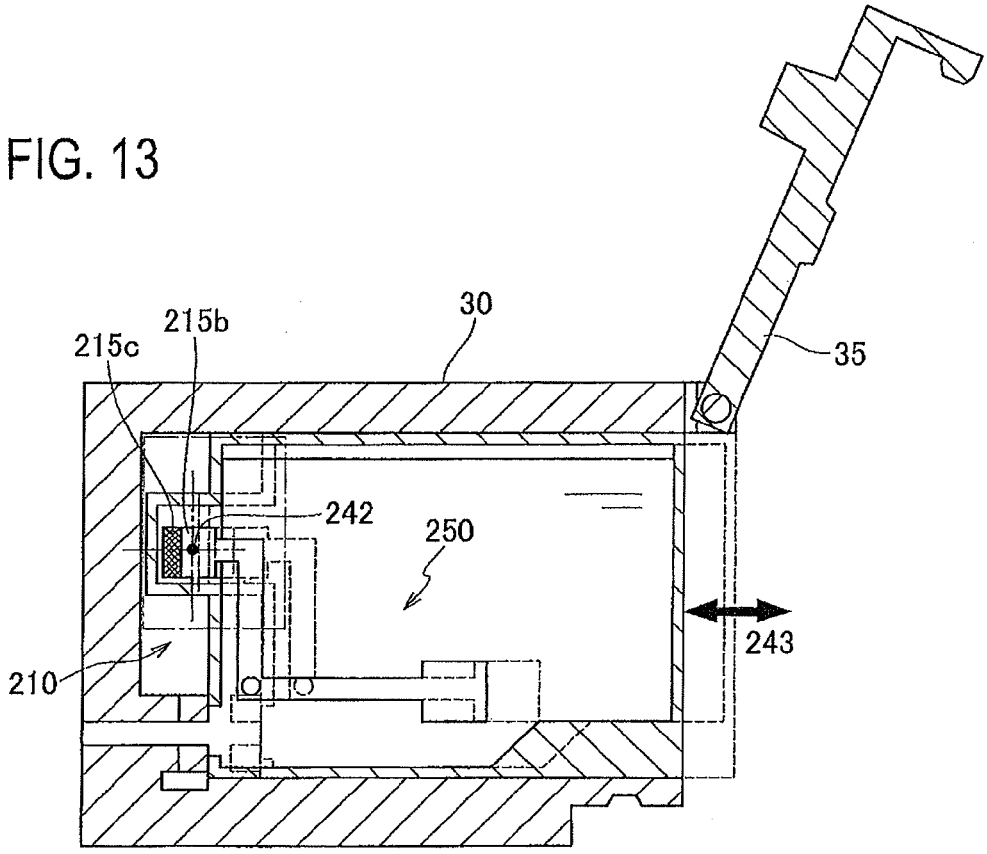
[FIG. 13] A cross-sectional view showing a state in which the ink cartridge according to the second embodiment is being mounted in or dismounted from a printer.

Further, the second embodiment shows a configuration that enables the remaining amount of ink 99 within the ink cartridge 210 to be detected not only when the ink cartridge 210 has been in the mounted attitude from the beginning of use until present, but also when the ink cartridge 210 is mounted in or dismounted from the accommodating case 30. FIG. 13 shows a state where the ink cartridge 210 is being mounted in or dismounted from the accommodating case 30. Broken lines represent the ink cartridge 210 in a state where the ink cartridge 210 is slid slightly to the right from the mounted attitude. When the ink cartridge 210 is mounted in or dismounted from the accommodating case 30, the ink cartridge 210 moves between the position indicated by the broken lines and the position in the mounted attitude. At this time, the irradiation range 242 moves relative to the irradiated section 215*b*, such that the irradiation range 242 cuts the irradiated section 215*b* in a direction parallel to a direction 243, for example.

FIG. 14(*a*), FIG. 14(*c*), and FIG. 14(*e*) are enlarged views of a region enclosed by a single-dot chain line in FIG. 13. FIG. 14(*a*), FIG. 14(*c*), and FIG. 14(*e*) show respective states where the irradiation range 242 moves relative to the irradiated section 215*b* when the ink cartridges 210 having a different residual amount of ink 99 are mounted in the accommodating case 30 along a direction of an arrow 244. The remaining amounts of ink 99 in FIG. 14(*a*), FIG. 14(*c*), and FIG. 14(*e*) correspond to the remaining amounts of ink 99 in FIG. 11(*a*) through FIG. 11(*c*). In FIG. 14(*a*), FIG. 14(*c*), and FIG. 14(*e*), solid lines show the ink cartridge 210 in the mounted attitude, while broken lines show the ink cartridge 210 immediately before the ink cartridge 210 takes the mounted attitude. Further, FIG. 14(*b*), FIG. 14(*d*), and FIG. 14(*f*) are graphs that represent changes in the intensity of light received by the light receiving element 31*b*, when the irradiation range 242 moves relative to the irradiated section 215*b* as shown in FIG. 14(*a*), FIG. 14(*c*), and FIG. 14(*e*), respectively.

In case of FIG. 14(*a*), the intensity of light received by the light receiving element 31*b* changes as shown in FIG. 14(*b*). First, prior to a state shown by the broken lines in FIG. 14(*a*), light from the light emitting element 31*a* is received by the light receiving element 31*b* without being blocked. At this time, the intensity of light is A1 (t32). Next, as the irradiation range 242 reaches the left side wall of the casing 214 of the ink cartridge 210, the light path is blocked by the casing 214. At this time, the intensity of light is A0 (t33). Next, when the irradiation range 242 finishes moving past the left side wall, the light path is formed in a space between the left side wall and the irradiated section 215*b*, and thus the intensity of light becomes A1 (t34). Next, the irradiation range 242 is located at the slit-formed section 215*c* of the irradiated section 215*b*, the intensity of light becomes A2 (t35). Then, in the mounted attitude shown by the solid lines in FIG. 14(*a*), because the irradiation range 242 is completely blocked by the irradiated section 215*b*, the intensity of light becomes A0 (t36).

In case of FIG. 14(*c*), the intensity of light received by the light receiving element 31*b* changes as shown in FIG. 14(*d*). First, prior to a state shown by the broken lines in FIG. 14(*c*), light from the light emitting element 31*a* is received by the light receiving element 31*b* without being blocked. At this time, the intensity of light is A1 (t37). Next, as the irradiation range 242 reaches the left side wall of the casing 214 of the ink cartridge 210, the light path is blocked by the casing 214. At this time, the intensity of light is A0 (t38). Next, when the irradiation range 1142 finishes moving past the left side wall, the light path is formed in a space between the left side wall and the irradiated section 215*b*, and thus the intensity of light becomes A1 (t39). Next, the irradiation range 242 is located at the slit-formed section 215*c* of the irradiated section 215*b*, the intensity of light becomes A2 (t40). Here, as shown by the solid lines in FIG. 14(*c*), when the ink cartridge 210 is inserted and takes the mounted attitude, the irradiation range 242 is located within the region of the slit-formed section 215*c*. Accordingly, the intensity of light is A2 at t40 and thereafter.

In case of FIG. 14(*e*), the intensity of light received by the light receiving element 31*b* changes as shown in FIG. 14(*f*). First, prior to a state shown by the broken lines in FIG. 14(*e*), light from the light emitting element 31*a* is received by the light receiving element 31*b* without being blocked. At this time, the intensity of light is A1 (t41). Next, as the irradiation range 242 reaches the left side wall of the casing 214 of the ink cartridge 210, the light path is blocked by the left side wall. At this time, the intensity of light is A0 (t42). Next, when the irradiation range 242 finishes moving past the left side wall, the light path is formed in a space between the left side wall and the irradiated section 215*b*, and thus the intensity of light becomes A1 (t43). Here, as shown by the solid lines in FIG. 14(*e*), when the ink cartridge 210 is inserted to take the mounted attitude, the irradiation range 242 is located between the irradiated section 215*b* and the left side wall. Accordingly, the intensity of light is A1 at t43 and thereafter.

As described above, in the second embodiment, when the ink cartridge 210 is being mounted in the accommodating case 30, the pattern of change in the intensity of light received by the light receiving element 31*b* differs depending on the amount of ink 99 left in the mounted ink cartridge 210. The control section 22 acquires the remaining amount of ink 99 within the ink cartridge 210 based on signals from the light receiving element 31*b*, when the ink cartridge 210 is being mounted in the accommodating case 30.

In the present embodiment, from when the irradiation range 242 moves past the left side wall 114*e* until the ink cartridge 210 takes the mounted attitude, the numbers of times intensity of light received by the light receiving element 31*b* becomes A0-A2 in each case of FIGS. 14(*b*), 14(*d*) and 14(*f*) are shown in Table 2.

TABLE 2

Figure 14A:
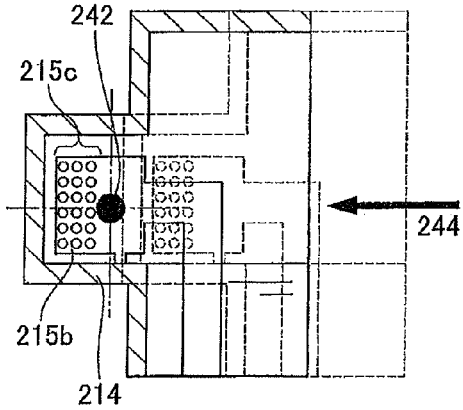
[FIG. 14] Partial enlarged views of FIG. 10 showing states where the ink cartridge according to the second embodiment is being mounted in or dismounted from the printer in response to amounts of ink remaining in the ink cartridge and corresponding graphs showing intensity of light, wherein (a) is a view illustrating a position of the remaining-amount detecting member when the remaining amount of ink is nearly at a maximum amount, (b) is a graph showing intensity of light that an optical sensor of (a) detects, (c) is a view illustrating a position of the remaining-amount detecting member when the remaining amount of ink becomes less than the state shown in (a), (d) is a graph showing intensity of light that the optical sensor of (c) detects, (e) is a view illustrating a position of the remaining-amount detecting member when the remaining amount of ink becomes even smaller, and (f) is a graph showing intensity of light that the optical sensor of (e) detects.
Figure 14B:
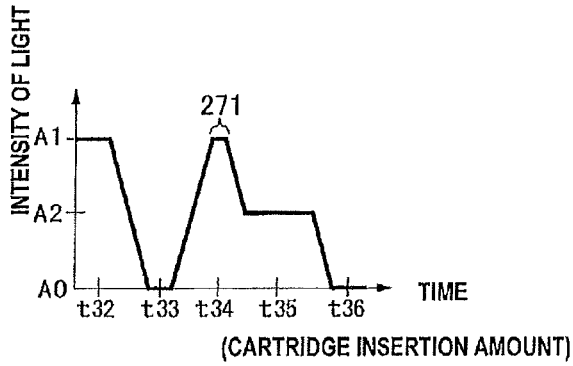
Figure 14C:
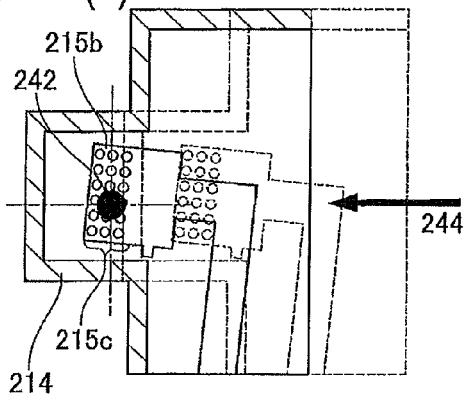
Figure 14D:
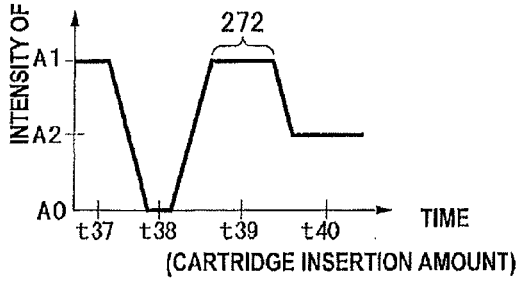
Figure 14E:
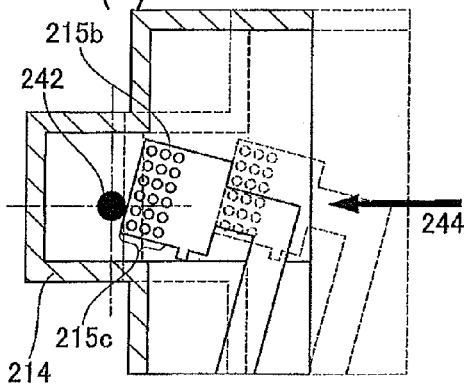
Figure 14F:
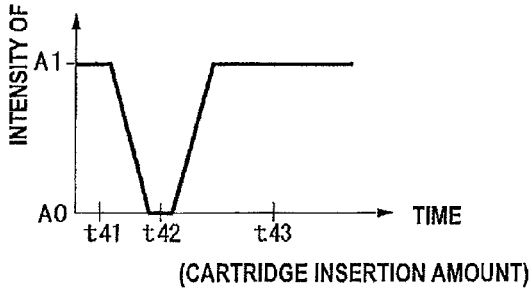

| | Number of times of A0 (time) | Number of times of A1 (time) | Number of times of A2 (time) |
|---|---|---|---|
| FIG. 14(b) | 1 time(t36) | 1 time(t34) | 1 time(t35) |
| FIG. 14(c) | 0(—) | 1 time(t39) | 1 time(t40) |
| FIG. 14(f) | 0(—) | 1 time(t18) | 0(—) |

The control section 22 stores data indicating Table 2 in the memory. Meanwhile, the control section 22 acquires respective numbers of times the intensity of light received by the light receiving element 31*b* become A0-A2, based on the signals from the light receiving element 31*b*. The control section 22 can detect which case among FIG. 14(*b*), FIG. 14(*d*) and FIG. 14(*f*) corresponds to the residual amount of ink in the mounted link cartridge 210 by comparing the acquired numbers of times with the data stored in the memory. Then, the control section 22 informs the user of the detected remaining amount of ink 99 via the notifying section 29. For example, when the remaining amount of ink 99 is smaller than a predetermined value, the control section 22 may warn the user that the remaining amount of ink 99 is small via the notifying section 29.

Note that, in the second embodiment, remaining amounts of ink 99 becomes A0 at t36, A2 at 40, and A1 at t43, respectively, i.e., different from each other in the state where the ink cartridge 210 is inserted in the accommodating case 30 to take the mounted attitude. Accordingly, the remaining amounts of ink may be detected based only on whether the intensity of light received by the light receiving element 31*b* is any one of A0-A1 when the ink cartridge 210 is mounted in the accommodating case 30 and takes the mounted attitude.

Further, in the second embodiment, the remaining amount of ink 99 can be detected in at least three stages at the time of mounting the ink cartridge 210, as shown in FIG. 14. However, the remaining amount of ink 99 can be grasped in more than or equal to four stages. For example, as shown in FIG. 14(*a*) and FIG. 14(*c*), the separation distance between the irradiated section 215*b* and the casing 214 is different depending on the remaining amount of ink 99. Thus, as shown in FIG. 14(*b*) and FIG. 14(*d*), the lengths of a time period 271 and a time period 272 during which the intensity of light is A1 are different from each other. Based on this information, the remaining amount of ink 99 can be grasped in more than or equal to four stages in total, by determining that the remaining amount of ink 99 becomes smaller as the time period 272 is longer. Moreover, as in the first embodiment, residual amounts of ink 99 can also be detected when the ink cartridge 210 is dismounted from the accommodating case 30.

Third Embodiment

Figure 15A:
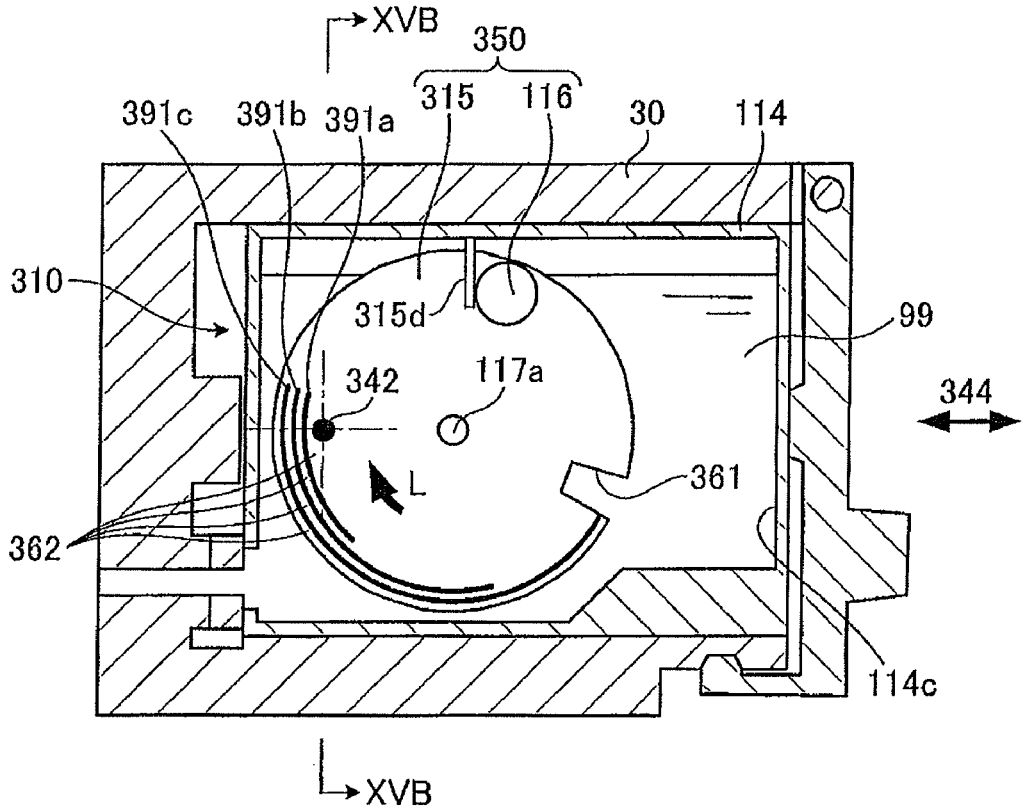
[FIG. 15] (*a*) is a cross-sectional view showing a configuration of an ink cartridge according to a third embodiment and its surroundings, and (b) is a cross-sectional view taken along a line XVB-XVB in (a)
Figure 15B:
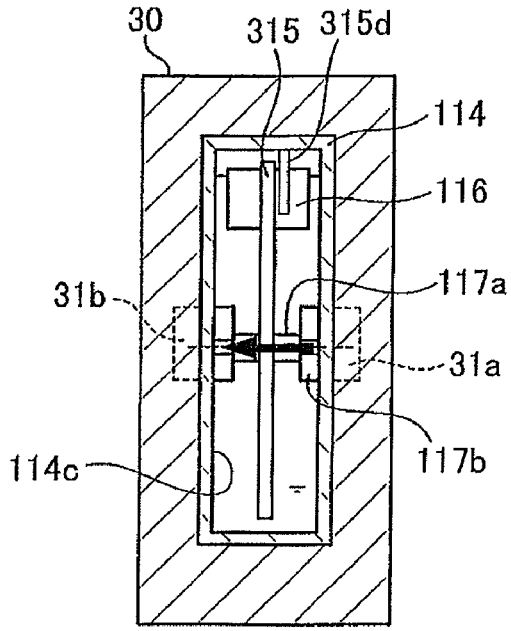
Figure 16A:
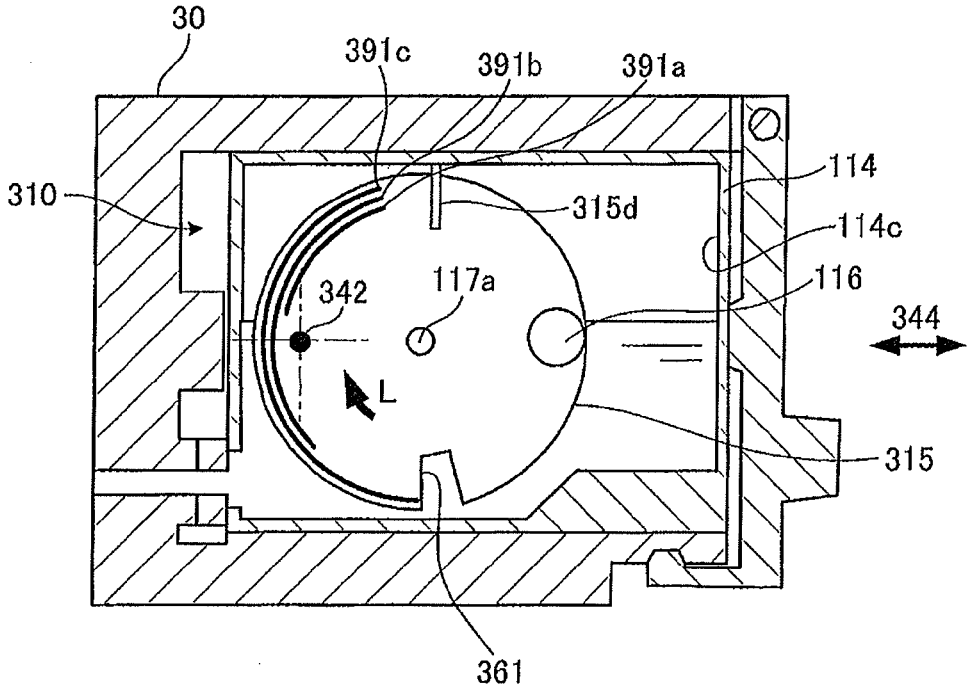
[FIG. 16(*a*)] A cross-sectional view showing the configuration of the ink cartridge and its surroundings when the amount of ink becomes smaller than the state of FIG. 15.
Figure 16B:
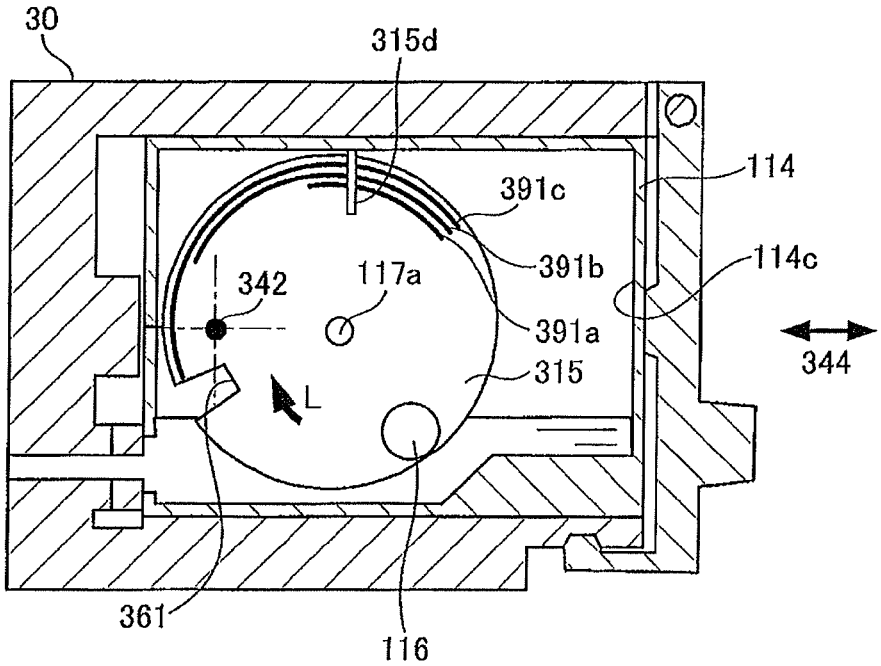
Figure 16C:
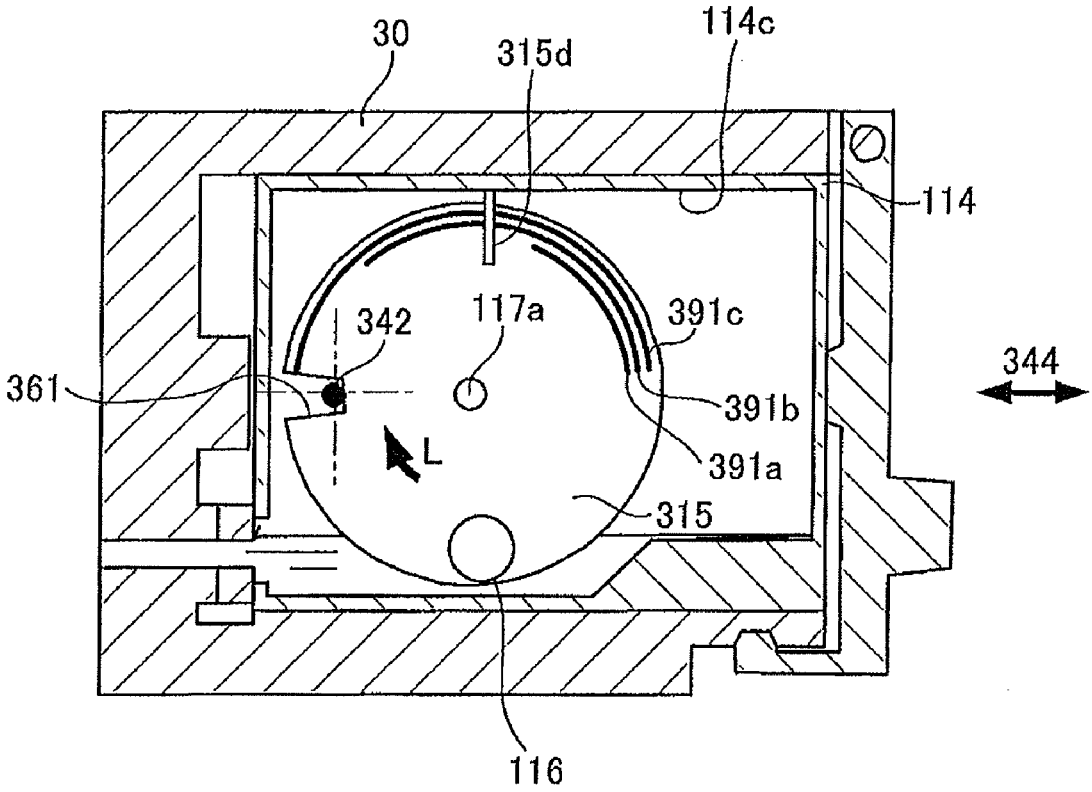
Figure 16D:
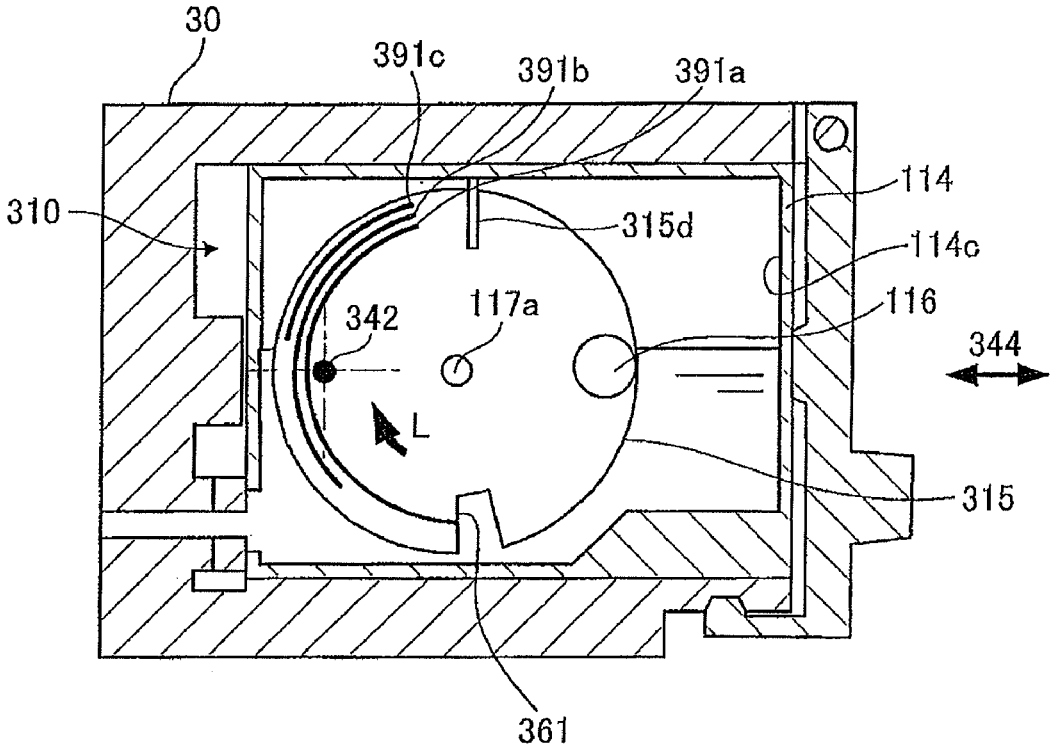

Hereinafter is a description on a third embodiment. Note that, explanations for configurations the same as those of the first embodiment are omitted. Also, for the configurations identical to those in the first embodiment, the same reference numerals are provided. FIG. 15(*a*) is a view showing a configuration of an ink cartridge 310 according to the third embodiment and the accommodation case 30. FIG. 15(*b*) is a cross-sectional view taken along a line XVB-XVB in FIG. 15(*a*).

The ink cartridge 310 is provided with a remaining-amount detecting mechanism. The remaining-amount detecting mechanism includes a remaining-amount detecting member 350. The remaining-amount detecting member 350 is integrally formed of a disk-shaped detection member 315 and the float member 116. The float member 116 is fixed to a position close to the periphery of the detection member 315. The detection member 315 is a disk-shaped plate member. The detection member has a diameter slightly smaller than the height of the ink accommodating chamber 114*c*. The detection member is disposed at a position center of the ink accommodating chamber 114*c* with respect to the left-right direction in FIG. 15(*b*). A rod-shaped reverse-rotation preventing member 315*d* is provided at the ceiling of the ink accommodating chamber 114*c*. The reverse-rotation preventing member 315*d* contacts the float member 116 and restricts the movement of the float member 116. On the other hand, the pivot shaft 117*a* is fixed at the center of the disk-shaped detection member 315. The pivot shaft 117*a* is fixed at the center of the disk-shaped detection member 315. The pivot shaft 117*a* is supported by a bearing 117*b* fixed to the casing 114 so that the detection member 315 can pivotally move (can rotate). As the reverse-rotation preventing member 315*d* restricts the movement of the float member 116, the detection member 315 is restricted from rotating in a reverse direction but is able to rotate in a circumferential direction L. For example, when the liquid surface of ink 99 moves down as shown in FIG. 16(*a*) from a state in which the ink 99 is accommodated within the ink cartridge 310 to a maximum amount, the float member 116 is about to move down by following the liquid surface of ink 99. In conjunction with this, the detection member 315 is about to rotate. At this time, because the reverse-rotation preventing member 315*d* restricts rotation in the reverse direction, the detection member 315 rotates in the direction L. Note that the reverse-rotation preventing member 315*d* need not be necessarily provided. Similar operations are made possible if the float member 116 is arranged at a position moved in the normal rotational direction from a position directly above in FIG. 15(*a*) (the twelve o'clock position in a clock) when the remaining amount of ink 99 is close to the maximum amount. However, providing the reverse-rotation preventing member 315*d* can more reliably present the detection member 315 from rotating in the reverse direction, even in disturbances such as vibrations.

In the present embodiment, the light emitting element 31*a* and the light receiving element 31*b* are disposed respectively at a position substantially center of the accommodating case 30 in the up-down direction, and leftward in the casing 114 in FIG. 15(*a*). Also, the pivot shaft 117*a* is supported by the bearing 117*b* so that a detection position 342 onto which light from the light emitting element 31*a* is irradiated comes to a prescribed position. In this way, the detection position 342 is brought into a position close to the center of the detection member 315 with respect to the up-down direction, vicinity of the left end of the detection member 315, and the same as that of the pivot shaft 117*a* in vertical direction.

The detection member 350 has a slit 361. The slit 361 is formed at a position rotated clockwise from the position of the float member by approximately 90 degrees in a circumferential direction. The slit 361 cut the detection member 315 in a direction from the periphery to the center thereof at a length longer than the minimum distance from the periphery to the detection position 342 (refer to FIG. 16(*c*)).

The detection member 315 is formed with slits 391*a*-391*c* extending along the circumferential direction. The slits 391*a*-391*c* are formed in the vicinity of the circumference of the detection member 315. Of these, the slit 391*c* is closest to the circumference of the detection member 315, whereas the slit 391*a* is farthest from the circumference of the detection member 315. Of both ends of the slits 391*a* through 391*c*, each of the one ends farthest from the slit 361 is arranged at a position the same with each other with respect to the circumferential direction. The slits 391*a*-391*c* extend counterclockwise and along the circumferential direction in which each of the other ends is arranged at a position separated from the respective one ends. Of the other ends of the slits 391*a*-391*c*, the other end of the slit 391*a* is farthest from the slit 361 in the is circumferential direction, whereas the other end of the slit 391*b* is secondly farthest from the slit 361. And the other end of the slit 391*c* is closest to the slit 361. Note that, the other end of the slit 391*c* may be separated from the slit 361 or adjacent to the slit 361. Light blocking sections 362 are formed between each of the slits 391*a*-391*c*, and also in a region around the slit 361 for blocking the light irradiated from the light emitting element 31*a*.

Hereinafter, how the amounts of ink 99 left in the ink accommodating chamber 114*c* is detected is described. FIG. 15(*a*) and FIGS. 16(*a*) through 16(*c*) respectively show an internal configuration of the ink cartridge 310 in the mounted attitude. In these drawings, the amounts of ink 99 accommodated in the ink accommodating chamber 114*c* are different from each other. FIG. 15(*a*) shows a state where the ink 99 is nearly fully accommodated in the ink accommodating chamber 114*c*. At this time, the detection position 342 is located at a position vicinity of the ends of the slits 391*a*-391*c* far from the slit 361. The float member 116 is made of a resin material of which specific gravity is smaller than ink, or is formed with a cavity inside if the float member 116 is made of a material whose specific gravity is greater than ink. Thus, as a whole, the float member 116 has smaller specific gravity than ink 99. In addition, as can be understood from FIG. 15(*b*), since the float member 116 is larger than the detection member 315 with respect to a direction of the pivot shaft 117*a*, the float member 116 can occupy a relatively large volume so that buoyancy can be ensured readily. As the ink 99 decreases, the float member 116 begins to rotate clockwise about the pivot shaft 117*a* in FIG. 15(*a*). In conjunction with the movement of the float member 116, the detection member 315 rotates in the direction L.

Here, when the ink cartridge 310 is mounted or dismounted in a direction of an arrow 344, the slits 391*a*-391*c* move past the detection position 342. If these slits 391*a*-391*c* (first sections) are located at the detection position 342 when moving past the detection position 342, since light emitted from the light emitting element 31*a* passes through these slits, the intensity of light received by the light receiving element 31*b* is A1. If the light blocking sections 362 (second sections) are located at the detection position 342, since the light from the light emitting element 31*a* is blocked, the intensity of light received by the light receiving element 31*b* is A0. Hence, as in the first and second embodiments, how many slits have moved past the detection position 342 can be detected from combinations of the numbers of times the intensity of light received by the light receiving element 31*b* becomes A0 and A1 respectively. In the state shown in FIG. 15(*a*), since the slits 391*a*-391*c* move past the detection position 342, the detected number of slits is three. Meanwhile, the light blocking sections 362 block the irradiated light four times.

FIG. 16(*a*) shows a state where the ink 99 has decreased to a certain amount from the state of FIG. 15(*a*) In FIG. 16(*a*), the detection position 342 is located at a position between the end of the slit 391*a* closer to the slit 361 and the end of the slit 391*b* closer to the slit 361 with respect to the circumferential direction of the detection member 315. When the ink cartridge 315 is mounted along the direction 344, the slits 391*b* and 391*c* have moved past the detection position 342. Therefore, two slits are detected. Meanwhile, the number of times the light blocking sections 362 have blocked the irradiated light is three.

FIG. 16(*b*) shows a state where the ink 99 has further decreased to a certain amount from the state of FIG. 16(*a*). In FIG. 16(*b*), the detection position 342 is located at a position between the end of the slit 391*b* closer to the slit 361 and the end of the slit 391*c* closer to the slit 361 with respect to the circumferential direction of the detection member 315. When the ink cartridge 310 is mounted in the direction 344, the slit 391*c* moves past the detection position 342. Hence, detected number of slits is one, while the number of times the light blocking sections 362 block the irradiated light is two.

FIG. 16(*c*) shows a state where the ink 99 has further decreased from the state of FIG. 16(*b*), and becomes almost empty in the ink accommodating chamber 114*c*. In FIG. 16(*c*), the detection position is located within a region where the slit 361 (third portion) is formed. When the ink cartridge 310 is mounted along the direction 344, the slit-formed area is located on the path along which the detection position 342 moves. Hence, when the ink cartridge 310 is mounted, the detection member 315 never blocks the detection position 342. That is, no slit is detected.

As described above, the numbers of slits detected in each case of FIG. 15(*a*) and FIGS. 16(*a*) through 16(*c*) are different from each other, and the number of times the light blocking sections 362 block the irradiated light are also different from one another. Based on this difference, the control section 22 acquires numbers of slits from signals from the light receiving element 31*b*, and notifies the user of information on the residual amounts of ink in accordance with the acquired numbers via the notifying section 29. For example, depending on the numbers of slits being 3, 2, 1 or 0, a message may be shown on the display. The message may be such that the amount of ink 99 left in the mounted ink cartridge 310 is still sufficient, a replacement cartridge is necessary to be prepared since a smaller amount of ink 99 is left, the remaining amount of ink 99 will soon be empty, or the remaining amount mount of ink 99 is nearly empty, depending on the residual amounts of ink 99. Alternatively, the remaining amounts of ink 99 may be detected based on the numbers of times the light blocking sections 362 block the irradiated light.

In the third embodiment, the slits 391*a*-391*c* are formed such that the longest slit 391*c* is closest to the circumference of the detection member 315, whereas the shortest slit 391*a* is farthest from the circumference of the detection member 315. However, as a variation, the slits 391*a*-391*c* may be formed such that the longest slit 391 is farthest from the circumference of the detection member 315, while the shortest slit 319*a* is closest to the circumference of the detection member 315, as shown in FIG. 16(*d*). In this case, too, the control section 22 can acquire how much liquid is left in the liquid cartridge based on the differences in the numbers of slits detected, and on the differences in the number of times the light blocking sections 362 block the irradiated light.

Fourth Embodiment

Figure 17:
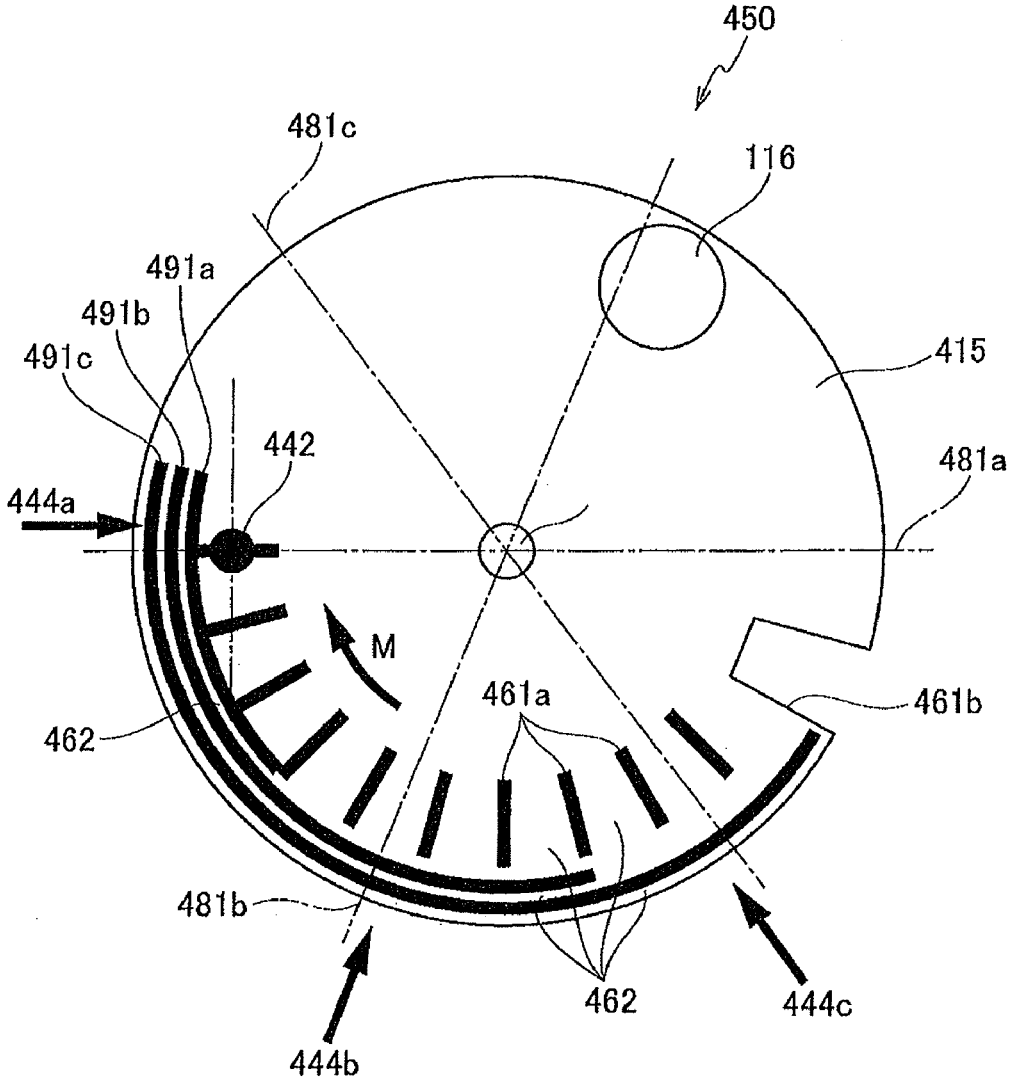
[FIG. 17] An elevation view of a remaining-amount detecting member in an ink cartridge according to a fourth embodiment.

In a fourth embodiment, the residual amounts of ink 99 within an ink cartridge can be acquired not only while the ink cartridge is being used (in a case where the ink cartridge has been in the mounted attitude since the beginning of use), but also when the ink cartridge is being mounted in and dismounted from an accommodating case. FIG. 17 shows a remaining-amount detecting member 450 according to the fourth embodiment. In the fourth embodiment, the remaining-amount detecting member 350 of the third embodiment is replaced by a remaining-amount detecting member 450.

The remaining-amount detecting member 450 includes a detection member 415 and the float member 116. The detection member 415 has a substantially disk shape. The float member 116 is fixed to a position vicinity of the circumference of the disk of the detection member 415.

The detection member 415 is formed with a plurality of slits 461. These slits 461 are arranged at an equal interval in the circumferential direction of the detection member 415. A slit 461*b* of the slits 461, which is closest to the float member 116 in the circumferential direction of the detection member 415, is formed such that the slit 461*b* has a width larger than those of other slits 461*a* in the circumferential direction. The slit 461*b* is formed at a position rotated clockwise from the position of the float member 116 by approximately 90 degrees in the circumferential direction. The slit 461*b* cuts the detection member 415 in a direction from the periphery to the center thereof at a length longer than the minimum distance from the periphery to a detection position 442. On the other hand, the widths of the slits 461*a* in the circumferential direction are identical to one another. Further, each slit 461*a* has a length identical to each other and extends from the vicinity of the circumference toward the center of the detection member 415. Light blocking sections 462 are formed between each of the slits 461*a* and the slit 461*b*.

In addition to the slits 461, the detection member 1215 is formed with slits 491*a* through 491*c* extending along the circumferential direction. Each of the slits 491*a* through 491*c* is formed in a region between the slits 461*a* and the circumference of the detection member 415. Of these, the slit 491*c* is closest to the circumference of the detection member 415, whereas the slit 491*a* is farthest from the circumference of the detection member 415. Each of one ends of the slits 491*a* through 491*c* is arranged at a position slightly closer to the float member 116 than the slit 461*a* farthest from the slit 461*b* in the circumferential direction. The other ends of the slits 491*a* through 491*c* are arranged at positions different from one another. The other end of the slit 491*a* is farthest from the slit 461*b* in the circumferential direction, whereas the other end of the slit 491*c* is closest to the slit 461*b*.

Having the above-described configuration, the remaining-amount detecting member 450 rotates in a direction M in accordance with decrease of ink, when the ink cartridge is mounted in the accommodating case and starts to be used. Hence, as the ink decreases, the slits 461*a* consecutively move past the detection position 442. That is, at the detection position 442, the slits 461*a* and the light blocking sections 462 are alternately detected. Based on this, the control section 22 counts how many slits 461*a* and the light blocking sections 462 have moved past the detection position 442 since when the ink cartridge is mounted, in accordance with the signals from the light receiving element 31*b*. And, based on the counted numbers, the control section 22 acquires the residual amounts of ink 99 at present.

The remaining-amount detecting member 450 can also acquire the remaining amounts of ink 99 when the ink cartridge is being mounted in and dismounted from the accommodating case, as described below.

FIG. 17 shows the detection position 442 when the remaining amount of ink 99 is close to the maximum amount. When the ink cartridge is mounted in the accommodating case in this state, the detection position 442 moves relative to the remaining-amount detecting member 450 along a single-dot chain line 481*a*, in a direction of an arrow 444*a*. Accordingly, by the time the ink cartridge has been mounted, the slits 491*a* through 491*c* move past the detection position 442. That is, when the remaining amount of ink 99 is close to the maximum amount, the optical sensor section 31 detects that all of the slits 491*a* through 491*c* have moved past the detection position 442.

As the ink 99 decreases, the remaining-amount detecting member 450 rotates within the ink cartridge in a direction M. Assume that the remaining amount of ink 99 has decreased to m1 which is smaller than the maximum amount. At the same time, suppose that the remaining-amount detecting member 450 has rotated along the direction M from the position shown in FIG. 17 by an angle formed between a single-dot chain line 481*b* and the single-dot chain line 481*a*. In such a state, when the ink cartridge is mounted in the accommodating case, the detection position 442 relatively moves in a direction of an arrow 444*b* along the single-dot chain line 481*b*. Accordingly, by the time the ink cartridge has been mounted, the slits 491*c* and 491*b* move past the detection position 442. That is, when the remaining amount of ink 99 is m1 (not shown), the optical sensor section 31 detects that two of the slits 491*a* through 491*c* have moved past the detection position 442.

Assume that the remaining amount of ink 99 has further decreased from m1 to become m2 (not shown) which is smaller than m1, and that the remaining-amount detecting member 450 has rotated from the position shown in FIG. 17 by an angle formed between a single-dot chain line 481*c* and the single-dot chain line 481*a*. When the ink cartridge is mounted in the accommodating case in this state, the detection position 442 relatively moves in a direction of an arrow 444*c* along the single-dot chain line 481*c*. Accordingly, by the time when the ink cartridge has been mounted, only the slit 491*c* moves past the detection position 442. That is, when the remaining amount of ink 99 is m2, the optical sensor section 31 detects that one of the slits 491*a* through 491*c* has moved past the detection position 442.

As described above, according to the fourth embodiment, when the ink cartridge having the remaining-amount detecting member 450 is mounted in and dismounted from the accommodating case, the residual amounts of ink 99 can be detected in three stages by detecting how many slits of the slits 491*a* through 491*c* have moved past the detection position 442 via the optical sensor section 31.

Further, in the present embodiment, the remaining amounts of ink 99 may also be detected based only on the numbers of times the light blocking sections 462 block the light irradiated from the light emitting element 31*a*. Alternatively, the residual amounts of ink 99 may also be detected by combinations of the number of times the light blocking sections 462 block the light from the light emitting element 31*a* and the number of slits that moved past the detection position 442.

Fifth Embodiment

Figure 18A:
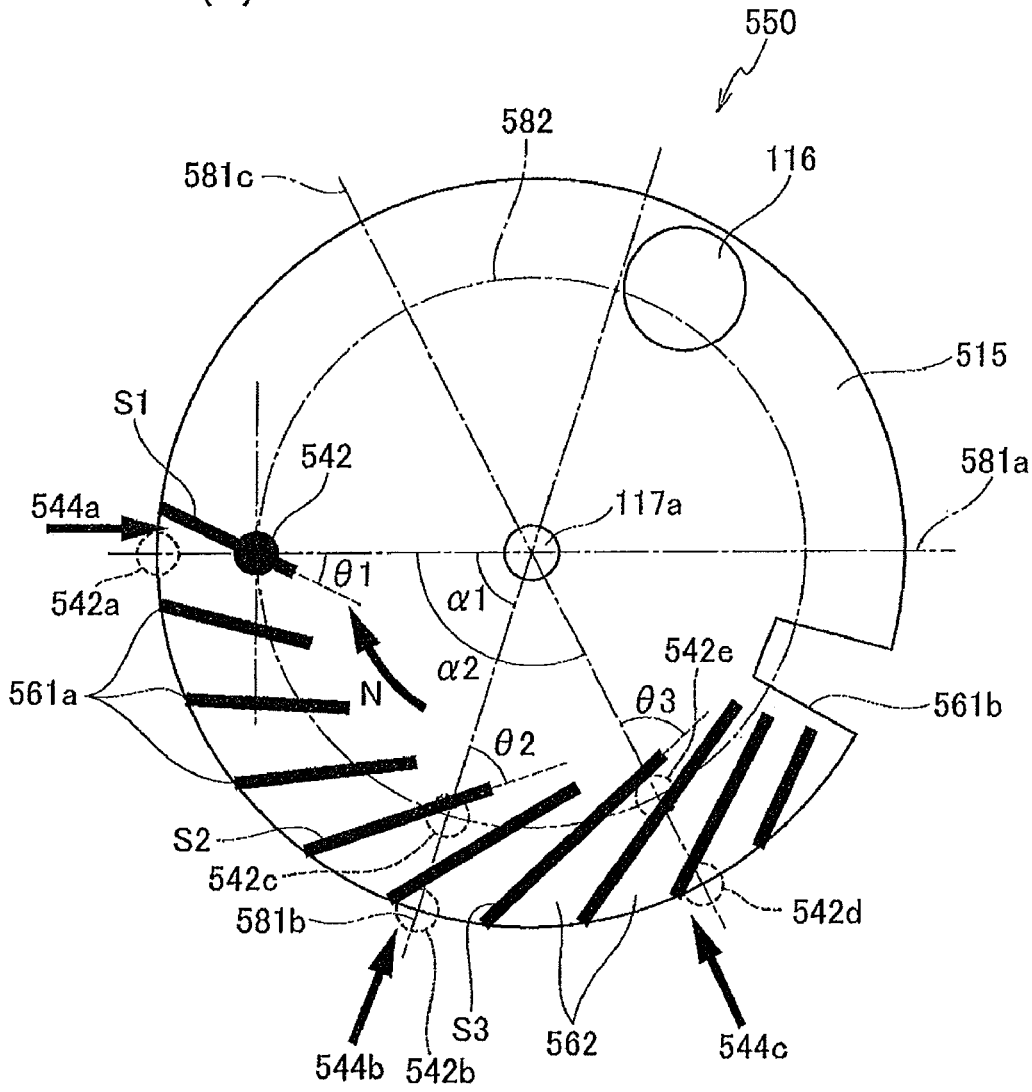
[FIG. 18(*a*)] An elevation view of a remaining-amount detecting member in an ink cartridge according to a fifth embodiment.
Figure 18B:
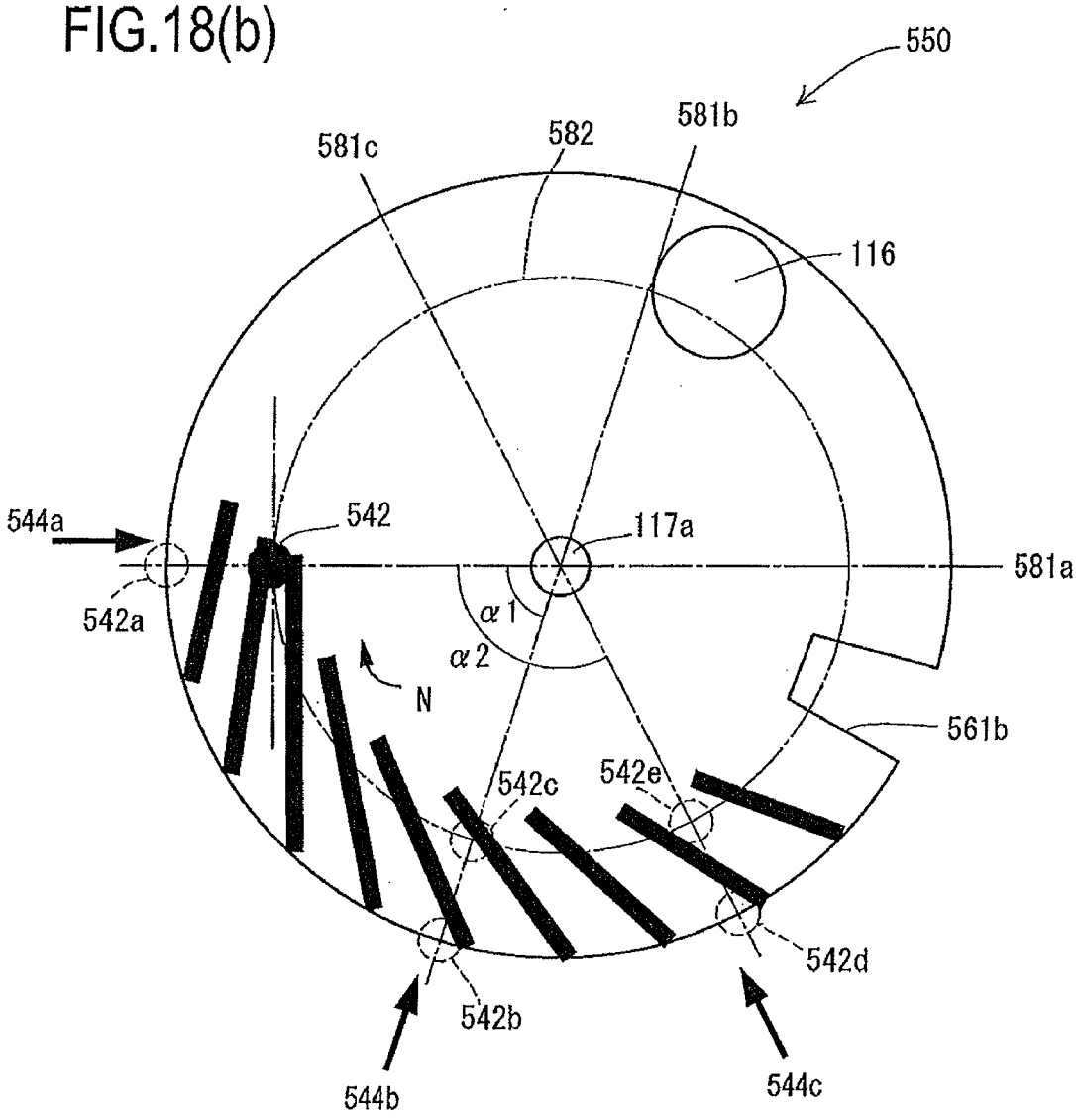

In a fifth embodiment, as in the fourth embodiment, remaining amounts of ink 99 in an ink cartridge can be acquired both while the ink cartridge is used and when the ink cartridge is being mounted in and dismounted from the accommodating case. Hereinafter, descriptions for configurations the same as those in the fourth embodiment are omitted. Also, for configurations the same as those in the fourth embodiment, the same reference numerals are provided. FIG. 18(*a*) shows a remaining-amount detecting member 550 according to the fifth embodiment, and FIG. 18(*b*) shows a remaining-amount detecting member 550 according to a variation of the fifth embodiment.

The remaining-amount detecting member 550 includes a detection member 515 and the float member 116. The detection member 515 is formed with a plurality of slits 561*a* and a slit 561*b*. The remaining-amount detecting member 550 corresponds to the remaining-amount detecting member 450 of the fourth embodiment in which the slits 561*a* are formed instead of the slits 461*a* and the slits 491*a* through 491*c*. Light blocking sections 562 are formed between each of the slits 561*a*.

One ends of the slits 561*a* are arranged on the circumference of the detection member 515. The slits 561*a* are formed such that each slit 561*a* extends linearly from one end thereof in a direction away from the circumference of the detection member 515. The other ends of the slits 561*a* are arranged inside a circle 582 and in a region adjacent to the circle 582. The circle 582 is concentric with the detection member 515 and smaller than the detection member 515. The slits 561*a* are formed such that acute angles formed between each slit 561*a* and the radial direction of the detection member 515 become larger as the slit 561*a* is closer to the slit 561*b*. For example, among slits s1-s3, the slit s1 is farthest from the slit 561*b*, whereas the slit s3 is closest to the slit 561*b*. Further, among the acute angles θ1-θ3 formed between each of the slits s1-s3 and the radial direction, the acute angle θ1 of the slit s1 farthest from the slit 561*b* is the smallest, whereas the acute angle θ3 of the slit s3 closest to the slit 561*b* is the largest.

Here, assume that an imaginary line 581*a* and a plurality of imaginary lines are drawn, the imaginary line 581*a* passing through the slit s1 and the center of the detection member 515, the plurality of imaginary lines being obtained by rotating the imaginary line 581*a* about the center of the detection member 515 in the counterclockwise direction of FIG. 18(*a*) (For example, imaginary lines 581*b* and 581*c* correspond to these imaginary lines). At this time, the slits 561*a* are formed in the detection member 515 such that the slits 561*a* further satisfy the following Condition 1 and Condition 2.

(Condition 1) The slits 561*a* are formed such that the number of the slits 561*a* intersected by the above-described imaginary line at a region outside the circumference of the circle 582 changes depending on rotational angles from the imaginary line 581*a*. The reason why the number of the slits 561*a* located only at the outer circumferential region is counted is that, this is the region that moves past a detection position 542 when the ink cartridge is being mounted or dismounted For example, the number of the slits 561*a* intersected by the imaginary line 581*a* at the outer circumferential region of the circle 582 is one. The number of the slits 561*a* intersected by an imaginary line 581*b* at the outer circumferential region of the circle 582 is two, the imaginary line 581*b* being obtained by rotating the imaginary line 581*a* by an angle α1. The number of the slits 561*a* intersected by an imaginary line 581*c* at the outer circumferential region of the circle 582 is three, the imaginary line 581*c* being obtained by rotating the imaginary line 581*a* by an angle α2 (>α1).

(Condition 2) The number of the slits 561*a* intersected by a certain imaginary line at the outer circumferential region of the circle 582 is greater than or equal to the number of the slits 561*a* intersected by any other imaginary line at the outer circumferential region of the circle 582, the any other imaginary line being obtained by rotating the imaginary line 581*a* by an angle smaller than the rotational angle of the certain imaginary line from the imaginary line 581*a*. That is, the slits 561*a* are formed such that the number of the slits 561*a* intersected by an imaginary line at the outer circumferential region of the circle 582 increases in a stepwise manner, as the rotational angle from the imaginary line 581*a* increases.

The above-described Condition 1 and Condition 2 will be described more specifically with reference to FIG. 18(*a*). In the remaining-amount detecting member 550 of FIG. 18(*a*), when the number of the slits 561*a* intersected by an imaginary line is one, the slits 561*a* are arranged as described below. For example, if the remaining-amount detecting member 550 rotates slightly in a direction N and the slit S1 has therefore moved away from the detection position 542 of FIG. 18(*a*) and thus is no longer detected, another slit 561*a* adjacent to the slit S1 in a direction opposite to the direction N may be arranged such that the outer-circumferential-side end thereof is located within the detectable area of the detection position 542.

Similarly, if the number of the slits 561*a* intersected by an imaginary line is two or more, the number of the slits 561*a* intersected by the imaginary line at the outer circumferential region of the circle 582 can be configured to increase in a stepwise manner in the remaining-amount detecting member 550 of FIG. 18(*a*), in consideration of the positional relationship between each slit 561*a* and each imaginary line together with the number of the intersected slits.

Having the slits 561*a* formed as described above, the remaining amount of ink 99 can be obtained by the remaining-amount detecting member 550 when the ink cartridge is being mounted in the accommodating case.

FIG. 18(*a*) shows the detection position 542 in a case where the remaining amount of ink 99 is close to the maximum amount. When the ink cartridge including the remaining-amount detecting member 550 therein is mounted in the accommodating case, the detection position 542 moves relative to the detection member 515 in a direction of an arrow 544*a* along the imaginary line 581*a*. In this case, the detection position 542 moves relative to the remaining-amount detecting member 550 from a detection position 542*a* to the detection position 542. Hence, when the remaining amount of ink 99 is close to the maximum amount, the number of the slits 561*a* detected by the optical sensor section 31 (corresponding to the slit s1) is one.

Next, when the ink 99 decreases from the state of FIG. 18(*a*), the remaining-amount detecting member 550 is in a position rotated in the direction N. When this ink cartridge is mounted in the accommodating case, the detection position 542 moves along one of imaginary lines X which is rotated about the center of the detection member 515 from the imaginary line 581*a*. For example, the detection position 542 moves in a direction of an arrow 544*b* along the imaginary line 581*b*. At this time, the number of slits 561*a* detected by the optical sensor section 31 at the detection position 542 is equal to the number of the slits 561*a* intersected by the imaginary line X at the region outside of the circumference of the circle 582. On the other hand, the slits 561*a* are formed so as to satisfy the above-described Condition 1 and Condition 2. Thus, as the number of the slits 561*a* intersected by the imaginary line X at the outer circumferential region of the circle 582 increases, the remaining-amount detecting member 550 is moved to a position rotated by a larger angle from the state of FIG. 18(*a*). That is, the remaining amount of ink 99 is determined to be smaller, as the number of slits 561*a* detected by the optical sensor section 31 at the detection position 542 is larger For example, when the detection position 542 moves along the imaginary line 581*b*, the detection position 542 moves relative to the remaining-amount detecting member 550 from a detection position 542*b* to a detection position 542*c*. Hence, the optical sensor section 31 detects two slits 561*a*. When the detection position 542 moves along the imaginary line 581*c*, the detection position 542 moves relative to the remaining-amount detecting member 550 from a detection position 542*d* to a detection position 542*e*. Hence, the optical sensor section 31 detects three slits 561*a*. Accordingly, the remaining amount of ink 99 is determined to be smaller in the latter case than in the former case.

Further, if the ink cartridge having the remaining-amount detecting member 550 is in use, as the ink 99 decreases, the detection position 542 moves relative to the detection member 515 along the circle 582 in a direction opposite to the direction N. Accordingly, the slits 561*a* and the light blocking sections 562 are detected alternately at the detection position 542. Hence, the remaining-amount detecting member 550 can also detect the remaining amount of ink 99 in multiple stages, during use of the ink cartridge.

Note that, in this embodiment, residual amounts of ink 99 may also be grasped based only on who many times the light blocking sections 562 block the light from the light emitting element 31*a*. Alternatively, remaining amounts of ink 99 may be detected by combinations of the number of times the light blocking sections 562 block the light from the light emitting element 31*a* and the number of slits that moved past the detection position 542.

As a variation, the slits 561*a* may be formed such that the number of the slits 561*a* intersected by an imaginary line at the outer circumferential region of the circle 582 decreases, as the rotational angle from the imaginary line 581*a* increases, as shown in FIG. 18(*b*). In this case, the condition 2 may be defined such that the number of the slits 561*a* intersected by a certain imaginary line at the outer circumferential region of the circle 582 is fewer than or equal to the number of the slits 561*a* intersected by any other imaginary line at the outer circumferential region of the circle 582, the any other imaginary line being obtained by rotating the imaginary line 581*a* by an angle smaller than the rotational angle of the certain imaginary line from the imaginary line 581*a*.

Sixth Embodiment

Figure 19:
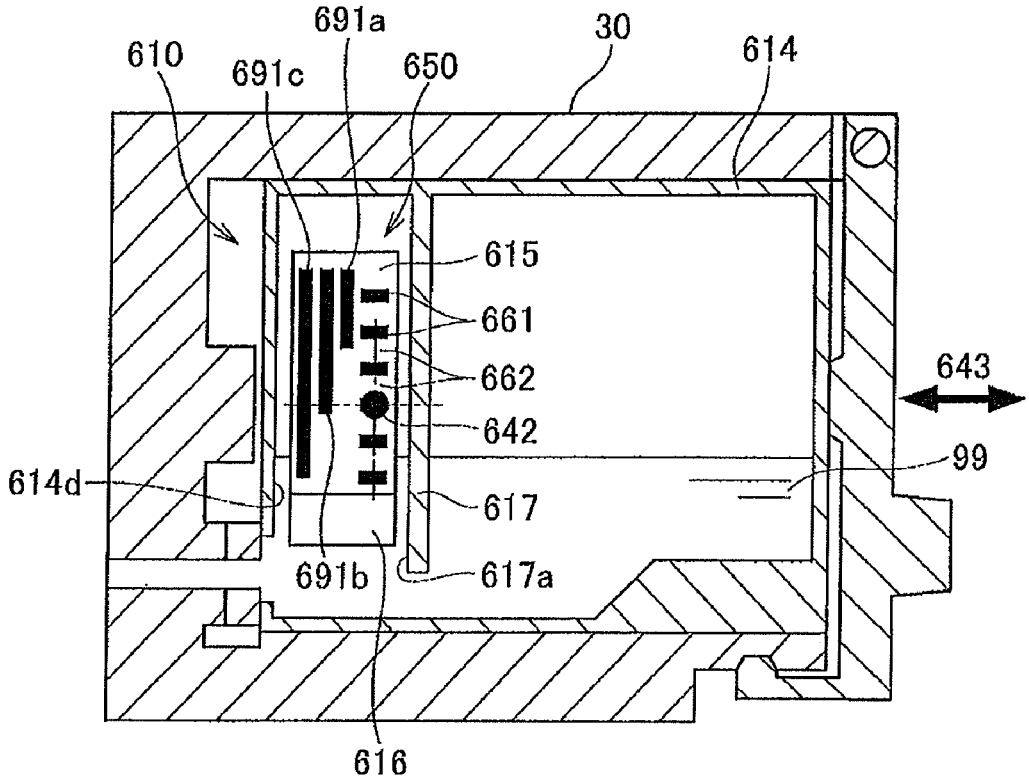
[FIG. 19] A cross-sectional view showing a configuration of an ink cartridge according to a sixth embodiment and its surroundings.

FIG. 19 is a cross-sectional view showing a configuration of an ink cartridge 610 according to a sixth embodiment and the accommodating case 30. Hereinafter, descriptions for configurations the same as those in the first embodiment are omitted. Aldo, for configurations the same as those in the first embodiment, the same reference numerals are provided.

A remaining-amount detecting member 650 according to the sixth embodiment integrally includes a detection member 615 and a float member 616. The float member 616 has an approximately rectangular parallelepiped shape, and has a mass per unit volume that is smaller than the density of ink 99. The detection member 615 is a plate-shaped member of which thickness direction is parallel to a direction extending from the near side toward the far side of FIG. 19. The float member 616 is fixed to the lower end of the detection member 615.

A plurality of slits 661 is formed in the detection member 615, the plurality of slits 661 being arranged in the up-down direction of FIG. 19. Each of the slits 661 has an identical shape and an identical size to each other. The slits 661 are arranged at an equal interval in the up-down direction. Light blocking sections 662 are formed between the slits 661.

The detection member 615 is formed with slits 691*a*-691*c* extending in the up-down direction. Each upper end of the slits 691*a*-691*c* is arranged at a position the same as each other in the up-down direction near the upper end of the detection member 615. Of the slits 691*a*-691*c*, the slit 691*c* is the longest in the up-down direction, the slit 691*b* has the second longest length, and the slit 691*a* is the shortest. Hence, the lower end of the slit 691*c* is closest to the float member 616, the lower end of the slit 691*b* is the second closest to the float member 616, and the lower end of the slit 691*a* is the farthest from the float member 616.

A restricting member 617 is integrally fixed to a casing 614 of the ink cartridge 610. The restricting member 617 is a plate-shaped member extending downward perpendicularly from the ceiling surface within the casing 614. The restricting member 617 is formed with a restricting surface 617*a* which is in parallel with the up-down direction. On the other hand, left-side inner wall surface 614*d* of the casing 614 extends in parallel with the restricting surface 617*a*, and is in confrontation with the restricting surface 617*a* in the left-right direction in FIG. 19. The restricting member 617 is arranged such that the separation distance between the inner wall surface 614*d* and the restricting surface 617*a* is slightly larger than the maximum width of the remaining-amount detecting member 650 in the left-right direction. Further, the remaining-amount detecting member 650 is arranged between the inner wall surface 614*d* and the restricting surface 617*a*. The restricting surface 617*a* and the inner wall surface 614*d* restrict the movement of the remaining-amount detecting member 650 in the left-right direction, and the remaining-amount detecting member 650 can move with respect to the up-down direction (restricting mechanism).

In the sixth embodiment, as ink 99 within the ink cartridge 610 decreases, the float member 616 moves down in accordance with the downward movement of the ink surface. In conjunction with this, the entirety of the remaining-amount detecting member 650 moves down. Because the remaining-amount detecting member 650 is restricted from the movement in the left-right direction of FIG. 19 by the inner wall surface 614*d* and the restricting surface 617*a*, the light blocking sections 662 do not move away from a detection position 642 in the left-right direction. With the downward movement of the remaining-amount detecting member 650, a state where the light blocking section 662 is located at the detection position 642 and a state where the slit 661 is located at the detection position 642 are repeated alternately. Accordingly, in the sixth embodiment, as in the fourth and other embodiments, the control section 22 can grasp in multiple stages how much amount of ink 99 is left at present, by counting how many times the state where the intensity of light is A1 and the state where the intensity of light is A0 have appeared by the present time.

When the ink cartridge 610 is mounted or dismounted in a mounting direction 643, a path along which the detection position 642 cuts across the remaining-amount detecting member 650 becomes different depending on residual amounts of ink 99. For example, when the ink 99 is nearly at the maximum amount, the upper end of the remaining-amount detecting member 650 is contact with the ceiling surface within the casing 614. At this time, the detection position 642 cuts across a region between the lower end of the slit 691*c* and the lower end of the slit 691*b*. Then, when the ink 99 has decreased by a certain amount, the remaining-amount detecting member 650 starts to move down from the ceiling surface within the casing 614. Next, as shown in FIG. 19, the detection position 642 comes to a position passing between the lower end of the slit 691*b* and the lower end of the slit 691*a*. When the ink 99 decreases further, the detection position 642 is located at a position passing between each upper end of the slits 691*a*-691*c* and the lower end of the slit 691*a*.

As described above, the remaining-amount detecting member 650 is so configured that how many slits out of the slits 691*a*-691*c* the detection position 642 moves past can change in response to the remaining amounts of ink 99. Accordingly, when the ink cartridge 610 is mounted in the accommodating case 30, detecting residual amounts of ink within the mounted ink cartridge 610 becomes possible by counting the number of slits that move past the detection position 642 based on signals from the light receiving element 31*b*.

Note that, in this embodiment, the remaining amounts of ink 99 may also be detected based only on the numbers of times the light blocking sections 662 block the light irradiated from the light emitting element 31*a*. Alternatively, the residual amounts of ink 99 may also be detected by combinations of the number of times the light blocking sections 662 block the light from the light emitting element 31*a* and the number of slits that moved past the detection position 642.

Figure 20:
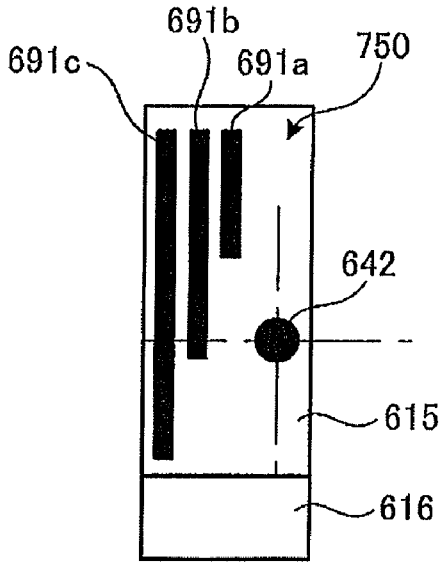
[FIG. 20] A variation of a remaining-amount detecting member according to the sixth embodiment.

Also note that, the present embodiment may also be used for detecting residual amounts of ink 99 within the ink cartridge 610 while the ink cartridge is in use, in addition to the case where the ink cartridge is being mounted in or dismounted from the accommodating case. This is because the remaining-amount detecting member 650 is formed with both the slits 661 and the slits 691*a*-691*c*. However, as in a remaining-amount detecting member 750 of FIG. 20, only the slits 691*a*-691*c* may be formed therein. In this case, residual amounts of ink 99 can be detected only when the ink cartridge is being mounted or dismounted.

<Other Variations>

A liquid cartridge and a recording system according to the present invention are not limited to the above-described embodiments, and various modifications and improvements can be made therein without departing from the scope of the claims. For example, the above-described embodiments employ such a configuration that a detection member and a float member are fixed integrally. However, these need not be fixed integrally if the detection member is configured to be able to move in conjunction with the movement of the float member. For example, the float member and the detection member are separate members, and the float member is in contact with the detection member. The float member moves to push the detection member in response to the movement of the float member as the ink 99 decreases, thereby making the detection member move along the predetermined path.

Figure 21A:
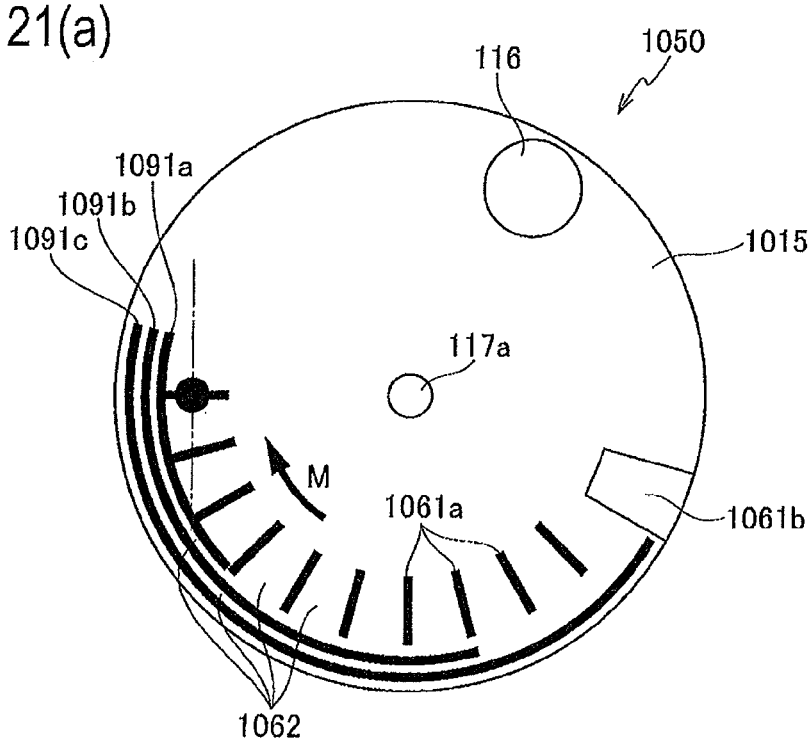
[FIG. 21] Schematic views showing a configuration of an ink cartridge according to a variation of the first to sixth embodiments and its surroundings, wherein (a) is an elevation view of a remaining-amount detecting member, (b) is a cross-sectional view showing light emitted from a light emitting element, and (c) is a cross-sectional view showing how light is reflected in the remaining-amount detecting member.
Figure 21B:
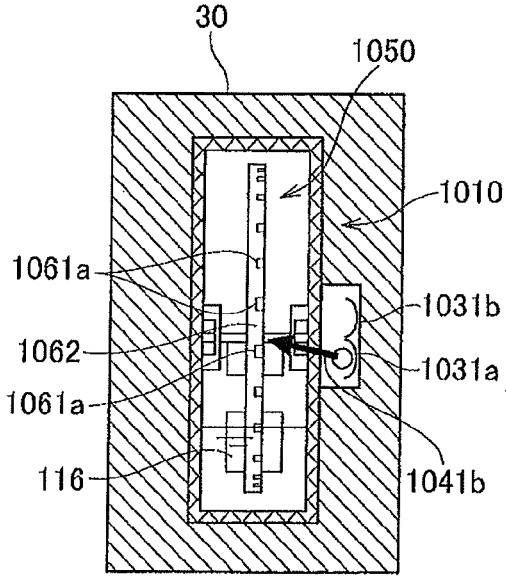
Figure 21C:
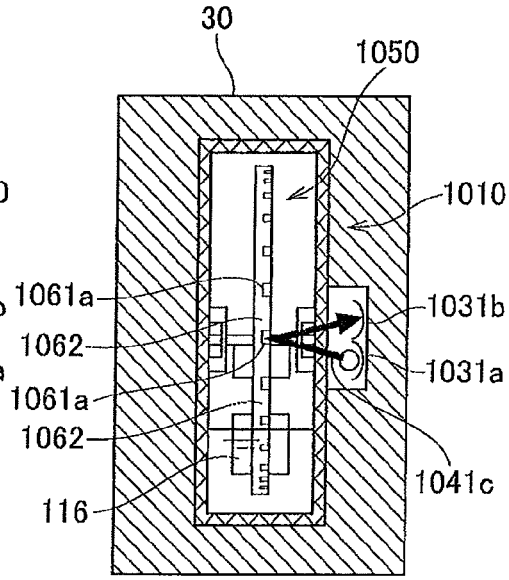

Further, the above-described embodiments have such a configuration that a detection member blocks light, thereby decreasing intensity of light received by the light receiving element 31*b*. However, residual amounts of ink 99 may be detected in such a configuration that the detection member reflects light from a light emitting element, and that a light receiving element detects the reflected light. For example, FIG. 21 shows an embodiment with such a configuration. FIG. 21(*a*) shows a remaining-amount detecting member 1050 including a detection member 1015 and the float member 116. In the detection member 1015, the slits 461*a*, 461*b*, and 491*a*-491*c* of the detection member 415 in the fourth embodiment are replaced by light reflecting sections 1061*a*, 1061*b* and 1091*a*-1091*c* that reflect light. That is, the light reflecting sections 1061*a*, 1061*b*, and 1091*a*-1091*c* correspond to the slits 461*a*, 461*b* and 491*a*-491*c*, respectively. Further, light blocking sections 1062 are formed between the light reflecting sections 1061*a* and 1061*b*, and between each of the light blocking sections 1091*a*-1091*c*.

FIG. 21(*b*) and FIG. 21(*c*) show an ink cartridge 1010 having the remaining-amount detecting member 1050 shown in FIG. 21(*a*) and the accommodating case 30. A light emitting element 1031*a* and a light receiving element 1031*b* are provided in the accommodating case 30. The angles formed between the light emitting element 1031*a* and the light receiving element 1031*b* are adjusted so that light from the light emitting element 1031*a* is reflected by the surface of the detection member 1015, and that the reflected light is received by the light receiving element 1031*b*. Thus, as shown in FIG. 21(*c*), when light 1041*c* from the light emitting element 1031*a* reaches the light reflecting section 1061*a*, 1061*b* or 1091*a*-1091*c*, the reflected light reaches the light receiving element 1031*b*. In contrast, as shown in FIG. 21(*b*), when light 1041*b* from the light emitting element 1031*a* reaches the light blocking section 1062, the reflected light does not reach the light receiving element 1031*b* because the light is blocked by the light blocking section 1062. In this way, the light reflecting sections 1061*a*, 1061*b* and 1091*a*-1091*c* has a function to direct light from the light emitting element 1031*a* toward the light receiving element 1031*a*, just as the slits 461*a*, 461*b* and 491*a*-491*c* (first section).

Hence, intensity of light received by the light receiving element 1031*b* when any of the light reflecting sections 1061*a*, 1061*b*, and 1091*a*-1091*c* is located at a detection position at which light from the light emitting element 1031*a* arrives is greater than intensity of light received by the light receiving element 1031*b* when the light blocking section 1062 is located at the detection position. Thus, an ink cartridge capable of detecting residual amounts of ink 99 therein based on the intensity of light received by the light receiving element 1031*b* can be realized as in the above-described embodiments. Note that, in the detection member 1015, a region other than the light reflecting sections 1061*a*, 1061*b* and 1091*a*-1091*c* may be made of a material having light transmissive characteristics. In this case, too, since light is not reflected in the region other than the light reflecting sections 1061*a*, 1061*b* and 1091*a*-1091*c*, the detection member 1015 has a function that prevents the reflected light from reaching the light receiving element 1031*b*, which is similar to the function of the light blocking sections 1062.

Figure 22:
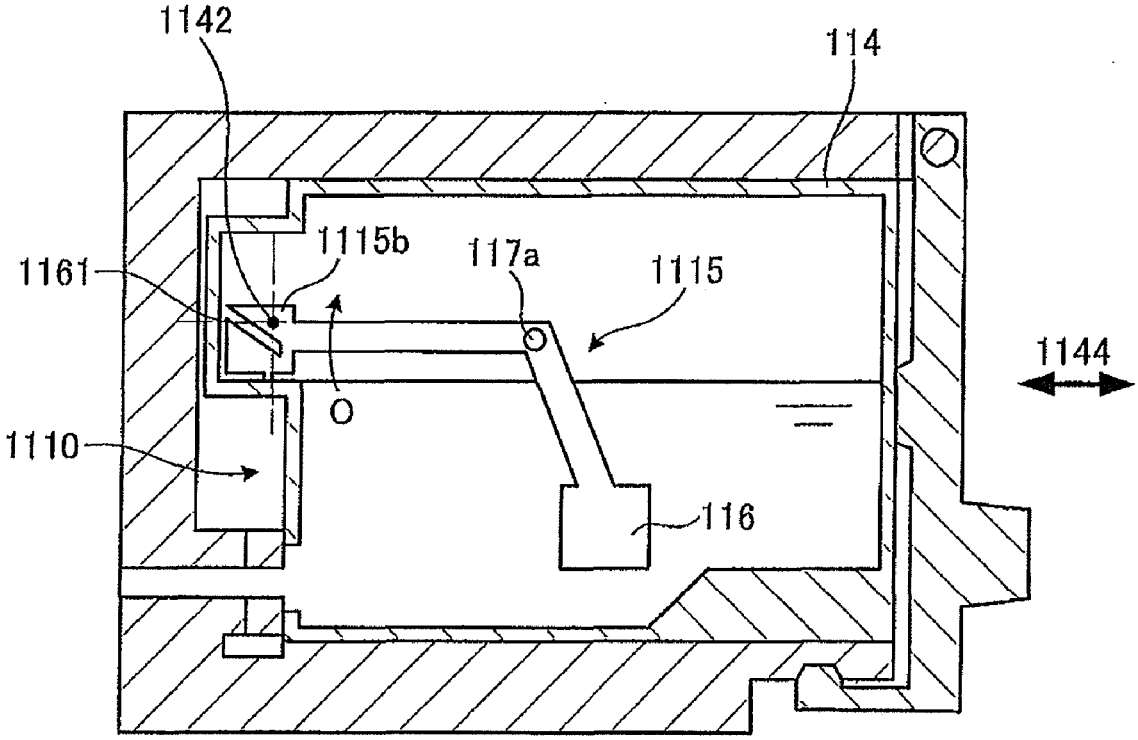
[FIG. 22] A cross-sectional view showing a configuration of an ink cartridge according to a variation of the first and second embodiments and its surroundings.

Further, in the above-described first and second embodiments, the irradiated section is disposed at a position substantially above the pivot shaft 117*a*. However, the positional relationship between the irradiated section and the pivot shaft 117*a* may be different from that in the embodiments described above. For example, in an ink cartridge 1110 of FIG. 22, an irradiated section 1115*b* is arranged at a position leftward of the pivot shaft 117*a*. In this case, when the ink 99 within the casing 114 has decreased to a certain amount, the irradiated section 1115*b* moves along a direction O, that is, substantially upward. Accordingly, a slit 1161 preferably cuts the irradiated section 1115*b* diagonally from upward left to downward right. In other words, when the irradiated section 1115*b* moves in accordance with the decrease of the ink 99, the slit 1161 may be preferably formed in such a shape that a detection position 1142 can cut across the slit 1161 so that the detection position 1142 can move relative to the slit 1161. In this way, if slits are formed in an appropriate shape, numbers of slits detected at the detection position 1142 and patterns of change in the intensity of light can reliably change when the ink cartridge 1110 is being mounted or dismounted in a direction 1144. Hence, even if the irradiated section 1115*b* is disposed at a position leftward of the pivot shaft 117*a*, the ink cartridge 1110 allows residual amounts of ink to be detected at the time of detachment.

Further, the above-described embodiments include configurations where the detection member is formed with slits. These slits may be made of any material and have any shape, as long as the slits are configured to transmit light readily compared with the light blocking section. For example, a transparent resin material may be filled in through-holes penetrating the detection member, or slits may have a shape other than a rectangular shape or circular shape. Moreover, the light blocking section need not block light completely, and may be made of a material that does not transmit light readily, compared with the light transmission section such as slits.

Further, in the above-described embodiments, slits or through-holes that transmit light are formed in the detection member made of a material having light blocking characteristics. However, a seal material having light blocking characteristics may be affixed to the detection member made of material having light transmissive characteristics, with shapes and at positions the same as the slits or the like in the above-described embodiments. Hence, the light transmission section having a function similar to that in the above-described embodiments can be formed in a simple manner, and thus the remaining-amount detecting member can be manufactured easily.

As described above, according to the fifth embodiment, the remaining-amount detecting member 550 is configured such that the number of the slits 561*a* detected at the detection position 542 increases as ink decreases when the ink cartridge is mounted or dismounted. More specifically, as ink decreases, the number of detected slits 561*a* changes like (1) one→(2) two→(3) three. However, the remaining-amount detecting member may be configured such that the number of the detected slits 561*a* temporarily decreases as ink decreases. For example, the remaining-amount detecting member 550 may be configured such that the number of the detected slits 561*a* changes like (1) one→(2) zero→(3) one→(4) two→(5) one→(6) two→(7) three, as ink decreases. In this case as well, if the number of the detected slits 561*a* is zero, for example, the remaining amount of ink is determined to be at least greater than the state of (3) or later. If the number of the detected slits 561*a* is three, the remaining amount of ink is known to be small.

Note that, "irradiated section" in each embodiment corresponds to a portion of a detection member at which slits and light blocking sections are formed, unless explicitly described such as the irradiated section 115*b* in the first embodiment.

What is claimed is:

1. A liquid cartridge mountable in a recording device, the liquid cartridge comprising:

a liquid accommodating chamber that accommodates liquid therein;

a float movably disposed in the liquid accommodating chamber; and a detection section to be detected by an external light detector for determining remaining amounts of the liquid in the liquid accommodating chamber, the detection section being movably disposed in the liquid accommodating chamber to move along a predetermined path in conjunction with movements of the float, the light detector including a light emitting section that emits light and a light receiving section that receives the light, the detection section including a first section and a second section, the first section transmitting the light when the first section is in a detection point, the second section blocking the light, the first section and the second section being arranged alternately, wherein an amount of liquid accommodated in the liquid accommodating chamber when the liquid cartridge is mounted in the recording device is determined based on a number of times the light emitted from the light emitting section traverses the alternately arranged first and second sections during mounting the liquid cartridge in a mounting direction in the recording device.

2. The liquid cartridge as claimed in claim 1, further comprising an arm section that connects the float and the detection section and is pivotably movably supported about a pivot point in the liquid accommodating chamber.

3. The liquid cartridge as claimed in claim 2, further comprising a restricting portion that restricts movements of the detection section to move only along the predetermined path and also restricts the float to remain immersed in the liquid at a predetermined position when the liquid surface is above the predetermined position.

4. The liquid cartridge as claimed in claim 3, wherein the float is movably supported by the arm section to be movable between the predetermined position and a lowermost position lower than the predetermined position.

5. The liquid cartridge as claimed in claim 4, wherein the float moves between the predetermined position and the lowermost position in accordance with change in liquid surface of the liquid accommodated in the liquid accommodating chamber.

6. The liquid cartridge as claimed in claim 2, wherein the detection section is positioned above the pivot point.

7. The liquid cartridge as claimed in claim 6, wherein the detection section includes at least one first section and at least two second sections; and wherein the first and second sections are arranged in the mounting direction.

8. The liquid cartridge as claimed in claim 1, wherein the detection section moves in a first direction along the predetermined path as the liquid accommodated in the liquid accommodating chamber decreases, the first direction being opposite to the mounting direction.

9. The liquid cartridge as claimed in claim 1, wherein the float and the detection section are integrally formed; and wherein the detection section is of a substantially disk-shaped and has a center, the detection section being pivotally movable about the center, a plurality of first sections and a plurality of second sections being coaxially arranged to be alternate in a radial direction, the plurality of first sections being shorter as closer to the center, a longest first section being arranged in an outermost position.

10. The liquid cartridge as claimed in claim 1, wherein the float and the detection section are integrally formed; and wherein the detection section has a substantially disk shape with a center, the detection section being pivotally movable about the center, a plurality of first sections and a plurality of second sections are coaxially arranged to be alternate in a radial direction, the plurality of first sections being longer as closer to the center, a longest first section being arranged in an innermost position.

11. The liquid cartridge as claimed in claim 9, wherein each of the plurality of first sections has a first end and a second end, the first ends are aligned in the radial direction.

12. The liquid cartridge as claimed in claim 11, wherein the detection section is further formed with a third section that transmits the light;

wherein the third section extends in the radial direction to the detection point;

wherein the second end of the longest first section extends to the third section.

13. The liquid cartridge as claimed in claim 11, wherein the detection section is further formed with a third section that transmits the light;

wherein the third section extends in the radial direction to the detection point; and wherein the second end of the longest first section is located at a position away from the third section.

14. The liquid cartridge as claimed in claim 10, wherein each of the plurality of first sections has a first end and a second end, the first ends are aligned in the radial direction.

15. The liquid cartridge as claimed in claim 14, wherein the detection section is further formed with a third section that transmits the light;

wherein the third section extends in the radial direction to the detection point; and wherein the second end of the longest first section is located at a position away from the third section.

16. The liquid cartridge as claimed in claim 14, wherein the detection section is further formed with a third section that transmits the light;

wherein the third section extends in the radial direction to the detection point;

wherein the second end of the longest first section extends to the third section.

17. The liquid cartridge as claimed in claim 1, wherein the float and the detection section are integrally formed;

wherein the detection section is substantially a disk-shaped having a center and a circumference along which a plurality of first sections and a plurality of second sections are arranged alternately, the detection section being pivotally movable about the center; and wherein each of the first sections has an elongated shape extending in a direction offset from a radial direction by an angle, the angles being larger as the plurality of first sections is circumferentially farther from the detection point.

18. The liquid cartridge as claimed in claim 17, wherein each of the plurality of first sections has a first end and a second end, each of the first ends of the first sections being formed at a position away from the center by an equi-distance; and wherein the number of times the first sections traverses the detection point increases in accordance with decrease in the liquid accommodated in the liquid accommodating chamber during mounting the liquid cartridge in the recording device.

19. The liquid cartridge as claimed in claim 18, wherein the plurality of first sections intersects with an inner circle, the inner circle having a center the same as the center of the disk-shaped detection section, the inner circle passing the detection point when the liquid cartridge is mounted in the recording device.

20. The liquid cartridge as claimed in claim 1, wherein the float and the detection section are integrally formed;

wherein the detection section is substantially a disk-shaped having a center and a circumference along which a plurality of first sections and a plurality of second sections are arranged alternately, the detection section being pivotally movable about the center; and wherein each of the first sections has an elongated shape extending in a direction offset from a radial direction by an angle, the angle being smaller as the plurality of the first sections is circumferentially farther from the detection point.

21. The liquid cartridge as claimed in claim 20, wherein each of the plurality of first sections has a first end and a second end, each of the first ends of the first sections being formed at a position away from the center by an equi-distance; and wherein the number of times the first sections traverses the detection point decreases in accordance with decrease in the liquid in the liquid accommodating chamber during mounting the liquid cartridge in the recording device.

22. The liquid cartridge as claimed in claim 21, wherein the plurality of first sections intersects with an inner circle, the inner circle having a center the same as the center of the disk-shaped detection section, the inner circle passing the detection point when the liquid cartridge is mounted in the recording device.

23. The liquid cartridge as claimed in claim 1, further comprising a restricting portion that restricts movements of the float and the detection section to be movable linearly in a second direction along the predetermined path, the second direction being perpendicular to a path of light emitted from the light emitting section and also being perpendicular to the mounting direction;

wherein the first section extends in the second direction; and wherein the first section and the second section are arranged in the mounting direction.

24. The liquid cartridge as claimed in claim 23, wherein a plurality of first sections is formed in the detection section, each of the first sections having a length different from each other.

25. A recording system comprising:

a liquid cartridge; and a recording device including:

a mount section in which the liquid cartridge is mounted; and a light detector including a light emitting section that emits light and a light receiving section that receives the light from the light emitting section, a portion of the ink cartridge mounted in the mount section being interposed between the light emitting section and the light receiving section, the liquid cartridge comprising:

a liquid accommodating chamber that accommodates liquid therein;

a float movably disposed in the liquid accommodating chamber; and a detection section to be detected by the light detector for determining remaining amounts of the liquid in the liquid accommodating chamber, the detection section being movably disposed in the liquid accommodating chamber to move along a predetermined path in conjunction with movements of the float, the detection section including a first section and a second section, the first section transmitting the light, the second section blocking the light, the first section and the second section being arranged alternately, wherein an amount of liquid accommodated in the liquid accommodating chamber when the liquid cartridge is mounted in the recording device is determined based on a number of times the light emitted from the light emitting section traverses the alternately arranged first and second sections during an operation to mount the liquid cartridge in the recording device.

* * * * *